US005859381A

United States Patent [19]

Takahashi et al.

[11] Patent Number: 5,859,381

[45] Date of Patent: Jan. 12, 1999

[54] AUTOMATIC ACCOMPANIMENT DEVICE AND METHOD PERMITTING VARIATIONS OF AUTOMATIC PERFORMANCE ON THE BASIS OF ACCOMPANIMENT PATTERN DATA

[75] Inventors: Makoto Takahashi; Yoshihisa Ito, both of Hamamatu, Japan

[73] Assignee: Yamaha Corporation, Japan

[21] Appl. No.: 816,171

[22] Filed: Mar. 12, 1997

[30] Foreign Application Priority Data

Mar. 12, 1996 [JP] Japan ..... 8-083154
Mar. 12, 1996 [JP] Japan ..... 8-083155

[51] Int. Cl.[6] ..... G10H 1/38; G10H 7/00

[52] U.S. Cl. ..... 84/613; 84/637

[58] Field of Search ..... 84/609, 610, 613, 84/634, 637, 649, 650, 666, 669

[56] References Cited

U.S. PATENT DOCUMENTS 5,088,380 2/1992 Minamitaka ..... 84/637
5,403,967 4/1995 Takano ..... 84/613
5,418,325 5/1995 Aoki et al. ..... 84/613
5,563,361 10/1996 Kondo et al. ..... 84/637
5,612,501 3/1997 Kondo et al. ..... 84/637
5,670,731 9/1997 Imaizumi ..... 84/613

FOREIGN PATENT DOCUMENTS 64-33597 3/1989 Japan .
4-335398 11/1992 Japan .

*Primary Examiner*—William M. Shoop, Jr.
*Assistant Examiner*—Jeffrey W. Donels
*Attorney, Agent, or Firm*—Rossi & Associates

[57] ABSTRACT

It is determined which one of a plurality of predetermined attributes each component note of accompaniment pattern data belongs to, and there is generated information to control at least one tonal factor of the component note in accordance with the determined attribute. Thus, the accompaniment pattern data is controlled or modified for each of the component notes with the determined attributes. Also, for any of the component notes, of the accompaniment pattern data, corresponding to at least one given place in a relative tone pitch order, control information is set which controls at least one tonal factor such as tone pitch. Thus, the component note corresponding to the given place in the relative tone pitch order is controlled in accordance with the control information.

31 Claims, 21 Drawing Sheets

FIG. 3A
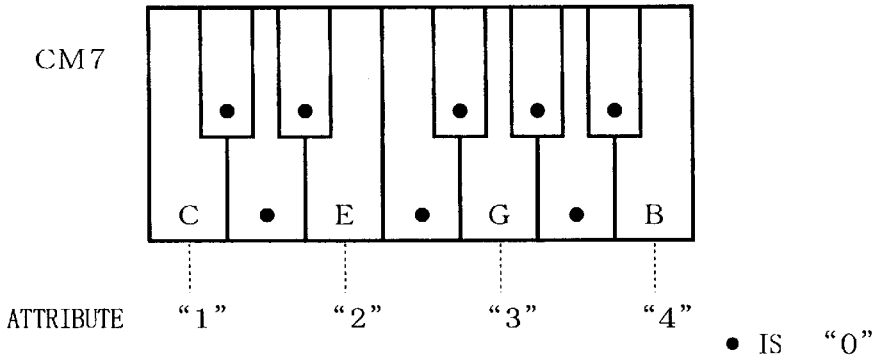
FIG. 3B
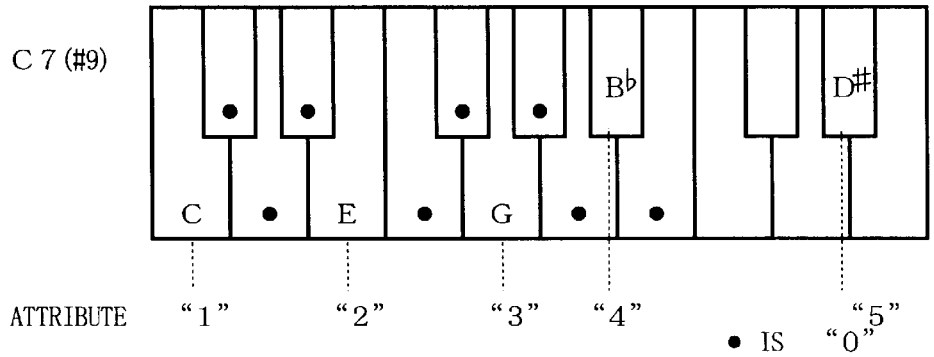
FIG. 3C
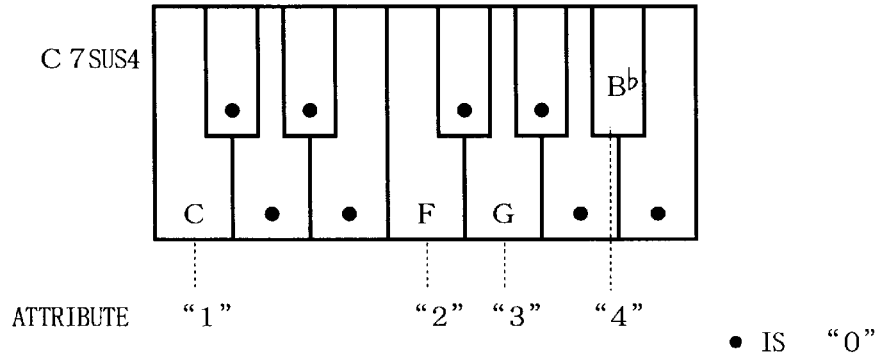
| ATTRIBUTE | OPEN HARMONY TABLE 1 | OPEN HARMONY TABLE 2 | OPEN HARMONY TABLE 3 |
|---|---|---|---|
| 1 | MUTE | THROUGH | THROUGH |
| 2 | THROUGH | MUTE | OCTAVE-UP |
| 3 | THROUGH | THROUGH | THROUGH |
| 4 | OCTAVE-DOWN | MUTE | THROUGH |
| 5 | OCTAVE-UP | MUTE | THROUGH |
FIG. 4

| TRACK | OPEN HARMONY TABLE NO. | COLOR NO. | 1ST MEASURE | 2ND MEASURE | 3RD MEASURE | 4TH MEASURE |
|---|---|---|---|---|---|---|
| TR1 | — | DRUM | PHRASE 1 | | | |
| TR2 | 2 | BASS | PHRASE 2 | | | |
| TR3 | 3 | PIANO | | | PHRASE 3 | |
| TR4 | 1 | GUITAR | PHRASE 4 | | | |

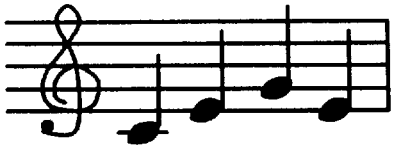
FIG. 26A
| PLACE | 1 | 2 | 3 |
|---|---|---|---|
| PITCH REPRESENTED BY NOTE NO. | C 3 | E 3 | G 3 |
FIG. 26B
| PLACE | 1 | 2 | 3 |
|---|---|---|---|
| PITCH REPRESENTED BY NOTE NO. | G 3 | E 3 | C 3 |
FIG. 26C
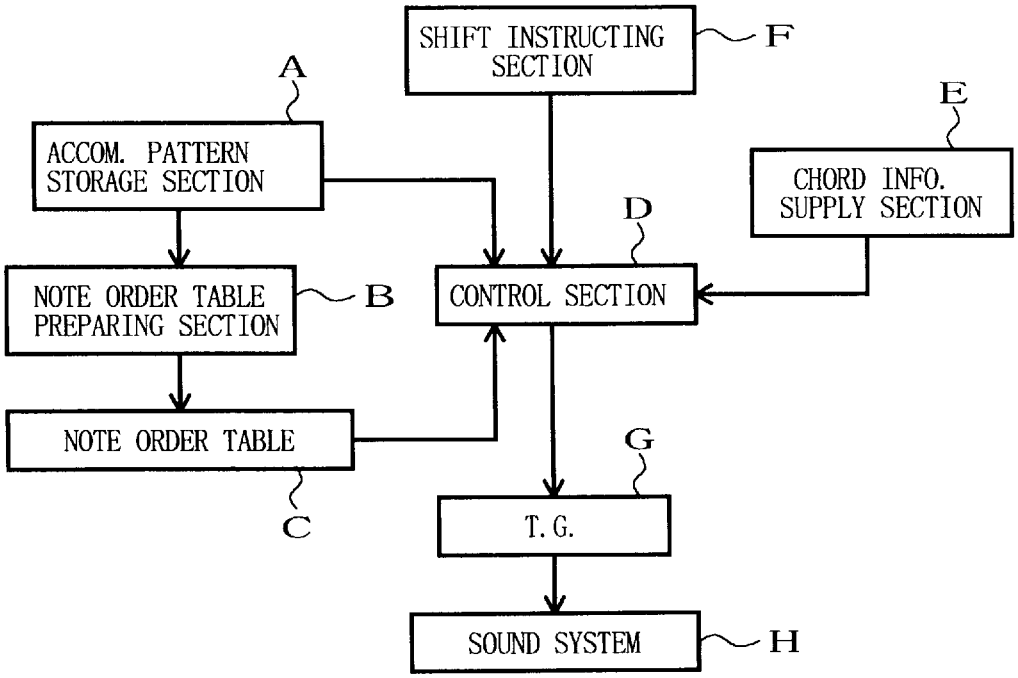
FIG. 28

AUTOMATIC ACCOMPANIMENT DEVICE AND METHOD PERMITTING VARIATIONS OF AUTOMATIC PERFORMANCE ON THE BASIS OF ACCOMPANIMENT PATTERN DATA

BACKGROUND OF THE INVENTION

The present invention relates generally to automatic accompaniment performance executed on the basis of accompaniment pattern data, and more particularly to an automatic accompaniment device which permits various variations of accompaniment performance on the basis of a same sort or group of accompaniment pattern data.

Automatic accompaniment devices are conventionally known which automatically execute an accompaniment performance in accordance with progression of a music piece on the basis of accompaniment pattern data provided for a plurality of accompaniment parts such as drum part, bass part, first chord backing part and second chord backing part. With such accompaniment devices, a particular accompaniment style is afforded by a combination of these accompaniment parts.

For the bass and chord backing parts, in the conventionally-known automatic accompaniment devices, accompaniment pattern data using a given chord (chord root and chord type) as its basic chord is converted in tone pitch (pitch-converted) through an auto. bass chord process in correspondence with a designated chord (chord root and chord type). Because the auto. bass chord process is executed in accordance with predetermined algorithms, an accompaniment performance with user desired voicing (i.e., a form of arrangement of component notes) could not necessarily be achieved on the basis of a same sort or group of accompaniment pattern data. One known approach to avoid the inconvenience has been to prepare and prestore many sorts of accompaniment pattern data in memory so that the user can select therefrom such accompaniment pattern data as to permit an accompaniment performance with desired voicing.

However, the preparation of many sorts of accompaniment pattern data was extremely time-consuming and cumbersome. In addition, in cases where many sorts of accompaniment pattern data are prestored in memory, the pattern data would occupy a great storage space in the memory, substantially reducing the size of other storage spaces that can be devoted to other data and programs. Besides, because the auto. bass chord process was executed in accordance with predetermines algorithms, an accompaniment performance could sometimes not be effected with a pitch range and sounding effect as desired by the user.

SUMMARY OF THE INVENTION

It is therefore an object of the present invention to provide an automatic accompaniment device which permits expanded variations of accompaniment performance based on a same sort of accompaniment pattern data and thus substantially reduce the number of sorts of accompaniment pattern data to be prepared in advance, to thereby effectively save time and labor and memory space necessary for preparing and prestoring the accompaniment pattern data.

It is another object of the present invention to provide an automatic accompaniment device which permits expanded variations of accompaniment performance based on a same sort of accompaniment pattern data in such a manner that a range and sounding effect of accompaniment tones can be optionally varied even after particular accompaniment pattern data is selected.

To accomplish the above-mentioned objects, the present invention provides an automatic accompaniment device which comprises: a pattern data supplying section which supplies accompaniment pattern data; an attribute determining section which determines which one of a plurality of predetermined attributes each of component notes in the accompaniment pattern data belongs to, in accordance with a relative tone pitch of the component note in the accompaniment pattern data; a control information generating section which generates control information to control at least one tonal factor in accordance with the attribute determined by the attribute determining section for each of the component notes; and a control section which, with respect to each of the component notes having their attribute determined by the attribute determining section, controls the accompaniment pattern data from the pattern data supplying section, in accordance with the control information generated by the control information generating section in correspondence with the attribute of the component note.

In the automatic accompaniment device, the attribute determining section classifies each component note of accompaniment data into any one of predetermined attributes. The control information generating section generates control information to control at least one tonal factor in accordance with the attribute determined for each of the component notes. Upon supply of the accompaniment pattern data from the pattern data supplying section, the control section, with respect to each of the component notes having their attribute determined by the attribute determining section, controls the accompaniment pattern data in accordance with the control information generated by the control information generating section in correspondence with the attribute of the component note.

In this way, the tonal factor of the accompaniment pattern data is controlled with respect to each of the component notes, so that various variations of accompaniment performance can be afforded on the basis of a same sort or group of accompaniment pattern data. Also, it suffices to only prepare and store a relatively smaller number of accompaniment pattern data in memory, with the result that it is possible to substantially reduce the necessary time and labor for preparing the accompaniment pattern data and save storage space of the memory. Further, because the control information generating section only has to generate one piece of control information for a plurality of component notes having a same attribute, it is possible to substantially reduce a necessary amount of control information as compared to a case where such control information is generated for each individual component note. This allows a user to optionally set contents of the control information with further increased ease.

An automatic accompaniment device according to another aspect of the present invention comprises: a pattern data supplying section which supplies accompaniment pattern data; a control information generating section which generates control information to control at least one tonal factor of any of component notes, of the accompaniment pattern data, corresponding to at least one given place in a relative tone pitch order; and a control section which, with respect to the component note corresponding to the given place in a relative tone pitch order, controls the accompaniment pattern data in accordance with the control information generated by the control information generating section.

In the automatic accompaniment device thus arranged, the control information generating section generates control information to control at least one tonal factor (e.g., tone pitch) of any of component notes, of the accompaniment pattern data, corresponding to at least one given place in a relative tone pitch order. By thus controlling t he tonal factor of the accompaniment pattern data for each of the component notes, the accompaniment tones can be varied in range and sounding effect, with the result that variations of the accompaniment tones based on a same sort of accompaniment pattern data can be expanded to a substantial degree.

An automatic accompaniment device according to still another aspect of the present invention comprises: a pattern data supplying section which supplies accompaniment pattern data; an arranging section which executes at least one of an operation for arranging component notes, of the accompaniment data supplied from the supplying section, in descending order of tone pitch and an operation for arranging the component notes in ascending order of tone pitch; a control information generating section which generates control information to control at least one tonal factor of any of the component notes corresponding to one or more given places in one of the descending and descending orders of tone pitch; and a control section which controls any of the component notes, of the accompaniment pattern data supplied from the supply section, corresponding to the given places for which the control information has been generated by the control information generating section, in accordance with the generated control information.

In the automatic accompaniment device thus arranged, the arranging section executes at least one of the operation for arranging component notes in the accompaniment data in descending order of tone pitch and the operation for arranging the component notes in ascending order of tone pitch. The control information generating section generates control information to control at least one tonal factor of any of the component notes corresponding to one or more given places in one of the descending and descending orders of tone pitch. Upon supply of the accompaniment pattern data from the pattern data supplying section, each of the component notes having their attribute determined by the attribute determining section is controlled by the control section in accordance with the control information generated by the control information generating section in correspondence with the attribute of the component note. In this case as well, by controlling the tonal factor of the accompaniment pattern data for each of the component notes, the accompaniment tones can be varied in range and sounding effect, with the result that variations of the accompaniment tones based on a same sort of accompaniment pattern data can be expanded to a substantial degree.

An automatic accompaniment device according to still another aspect of the present invention comprises: a pattern data supplying section which supplies accompaniment pattern data; an operator section which sets control information to control at least one tonal factor of any of component notes, of the accompaniment pattern data, corresponding to one or more given places in a relative tone pitch order; and a control section which, with respect to the component notes corresponding to the one or more given places in a relative tone pitch order, controls the accompaniment pattern data supplied from the supply section, in accordance with the control information set by the operator section.

In this automatic accompaniment device, the control information is set by user's operation of the operator section. Thus, even after selection of desired accompaniment pattern data, the accompaniment tones can be varied in range and sounding effect by activating the operator section. In a preferred embodiment, the operator section includes a first operator which selectively instructs that a tone pitch should be shifted in an upward or downward direction and a second operator which designates any of the component notes, of the accompaniment patten data, corresponding to one or more given places in the relative tone pitch order that are to be shifted in tone pitch, and the control section controls tone pitches of the component notes designated by the second operator in such a manner that the tone pitches are shifted in the direction designated by the first operator. With such an arrangement, any new desired range and sounding effect of the component notes can be achieved with ease, even in the course of an automatic accompaniment, by simple operation of selecting any of the component notes to be shifted and of designating a direction of the shifting.

An automatic accompaniment device according to still another aspect of the present invention comprises: a pattern data supplying section which supplies accompaniment pattern data; a chord designating section which designates a progression of an accompaniment chord; a converting section which pitch-converts the accompaniment pattern data supplied from the supplying section, on the basis of an accompaniment chord designated by the chord designating section; an identifying section which identifies any of tone pitches, of component notes of the accompaniment chord designated by the chord designating section, which is not present in the accompaniment pattern data pitch-converted by the converting section; an operator section which designates a given place in a relative tone pitch order, of one or more component notes in the accompaniment patten data, that are to be pitch-converted; and a control section which shifts a tone pitch of the one or more component notes corresponding to the given place designated by the operator section, to any one of the tone pitches identified by the identifying section.

In the automatic accompaniment device thus arranged, the identifying section identifies any of tone pitches (as an unused tone pitch), of component notes of the accompaniment chord designated by the chord designating section, which is not present in the accompaniment pattern data pitch-converted by the converting section on the basis of a designated accompaniment chord. For example, consider a case where the supplied accompaniment pattern data is one created on the basis of a chord consisting of three kinds of note names, such as a major or minor chord, and the designated chord is one consisting of four kinds of note names, such as a 7th, major 7th or minor 7th chord. When such accompaniment pattern data is pitch-converted on the basis of the designated chord, one of the four note names will be left unused within the same octave range and all the four note names in other ranges higher or lower than the octave range will be left unused. Further, in a case where the designated chord is one consisting of three kinds of note names, such as a major or minor chord, as with the accompaniment pattern data, no note name will be left unused within the same octave range, but all the three note names in other ranges higher or lower than the octave range will be left unused. Such unused tone pitches are identified by the identifying section. The control section shifts a tone pitch of the component note corresponding to the given place designated by the operator section, to any one of the tone pitches identified by the identifying section. By shifting the tone pitch to the unused tone pitch, it is possible to even further expand variations of accompaniment tones based on a same sort or group of accompaniment pattern data.

BRIEF DESCRIPTION OF THE DRAWINGS

For better understanding of the present invention, the preferred embodiments of the invention will be described in detail below with reference to the accompanying drawings, in which:

FIGS. 3A to 3C are diagrams conceptually showing exemplary stored contents of an attribute table in the embodiment of FIG. 1;

FIG. 4 is a diagram showing exemplary stored contents of an open harmony table in the embodiment of FIG. 1;

FIGS. 26A to 26C are diagrams showing examples of component notes in accompaniment pattern data and note order tables;

FIG. 28 is a block diagram showing the automatic accompaniment device of FIG. 17 in terms of its automatic accompaniment function;

DETAILED DESCRIPTION OF THE PREFERRED EMBODIMENTS

Figure 1:
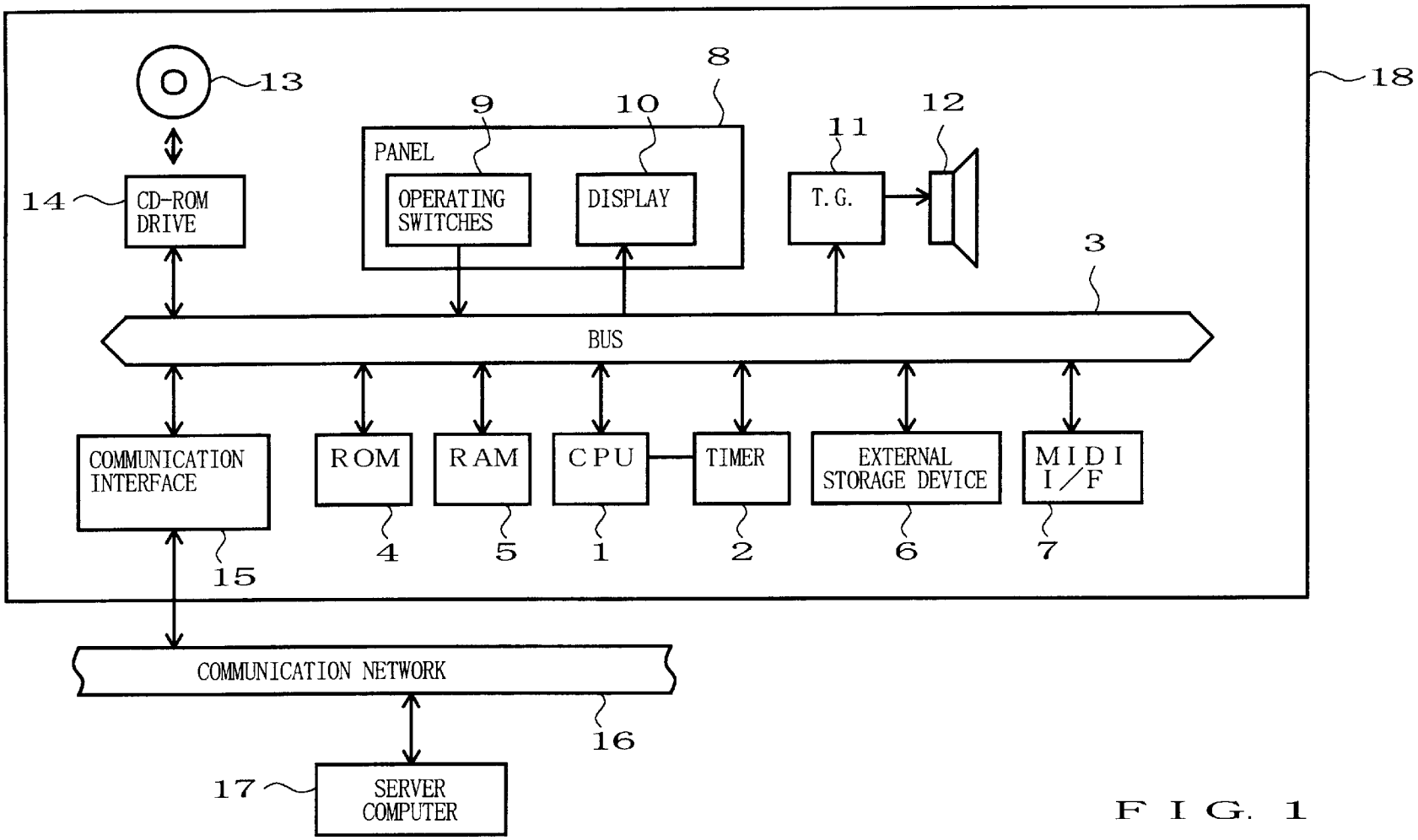
FIG. 1 is a block diagram illustrating a general hardware configuration of an automatic accompaniment device according to a first embodiment of the present invention.

FIG. 1 is a block diagram illustrating a general hardware configuration of an electronic musical instrument 18 employing an automatic accompaniment device according to a first embodiment of the present invention. The illustrated electronic musical instrument 18 comprises a tone generator device incorporated in a sequencer that includes a plurality of tracks for melody part and a plurality of tracks for accompaniment parts. A CPU 1 in the embodiment controls the overall operations of the electronic musical instrument 18, and a timer 2 supplies the CPU 1 with clock pulses having a frequency corresponding to a set tempo. The clock pulses are used as tempo clock signals to start various interrupt processes as will be later described in detail. To the CPU 1 are connected, via a bus 3, a ROM 4 and a RAM 5 as main storage devices, an external storage device (such as a floppy disk drive or hard disk drive) 6, a MIDI interface 7, an operation panel 8 (including operating switches 9 and a display 10), and a tone generator 11.

In this automatic accompaniment device, the accompaniment parts include drum, bass, first chord backing and second chord backing parts, and of the accompaniment part tracks, a first track TR1 corresponds to the drum part, a second track TR2 to the bass part, a third track TR3 to the first chord backing part, and a fourth track to the second chord backing part.

The ROM 4 has prestored therein programs descriptive of various processes to be executed by the CPU 1, a preset "attribute table", an "open harmony table", plural sorts or groups of "phrase data" preset in corresponding relations to the individual accompaniment parts, and preset "style data" (in some cases, the preset style data need not be stored). The RAM 5 includes areas for storing an "open harmony table", "phrase data", "style data", etc. created by a user, areas for storing various other data (including "chord sequence data"), and registers, flags etc. as will be later described in detail.

In a hard disk of the external storage device 6, there may be stored various other data such as automatic performance data and chord progression data and operating program. By prestoring the operating program in the hard disk rather than in the ROM 4 and loading the operating program into the RAM 5, the CPU 1 can operate in exactly the same way as where the operating program is stored in the ROM 4. This greatly facilitates version-up of the operation program, addition of another operating program, etc. A CD-ROM (compact disk) 13 may be used as a removably-attachable external recording medium for recording various data such as automatic performance data, chord progression data and tone waveform data and an optional operating program similarly to the above-mentioned. Such an operating program and data stored in the CD-ROM 13 can be read out by a CD-ROM drive 14 to be transferred for storage into the hard disk. This facilitates installation and version-up of the operating program. The removably-attachable external recording medium may of course be other than the CD-ROM, such as a floppy disk and magneto optical disk (MO).

A communication interface 15 may be connected to the bus 3 so that the electronic musical instrument 18 including the automatic accompaniment device of the invention can be connected via the interface 15 to a communication network 16 such as a LAN (Local Area Network), internet and telephone line network and can also be connected to an appropriate sever computer 17 via the communication network 16. Thus, where the operating program and various data are not contained in the hard disk, these operating program and data can be received from the server computer 17 and downloaded into the hard disk. In such a case, the automatic accompaniment device, a "client", sends a command requesting the server computer 17 to download the operating program and various data by way of the communication interface 15 and communication network 16. In response to the command, the server computer 17 delivers the requested operating program and data to the electronic musical instrument 18 via the communication network 16. The electronic musical instrument 18 completes the necessary downloading by receiving the operating program and data via the communication network 15 and storing these into the hard disk.

It should be understood here that the electronic musical instrument 18 including the automatic accompaniment device of the invention may be implemented by installing the operating program and various data corresponding to the present invention in any commercially available personal computer. In such a case, the operating program and various data corresponding to the present invention may be provided to users in a recorded form on a recording medium, such as a CD-ROM or floppy disk, which is readable by the personal computer. Where the personal computer is connected to a communication network such as a LAN, the operating program and various data may be supplied to the personal computer via the communication network similarly to the above-mentioned.

The above-mentioned "attribute table" in the ROM 4 is one which, for each chord type, prestores relative pitches of component notes of accompaniment pattern data in corresponding relations to a plurality of predetermined attributes; that is, in this table, component notes of accompaniment pattern data are classified into respective attributes in terms of their relative pitches.

Figure 2:
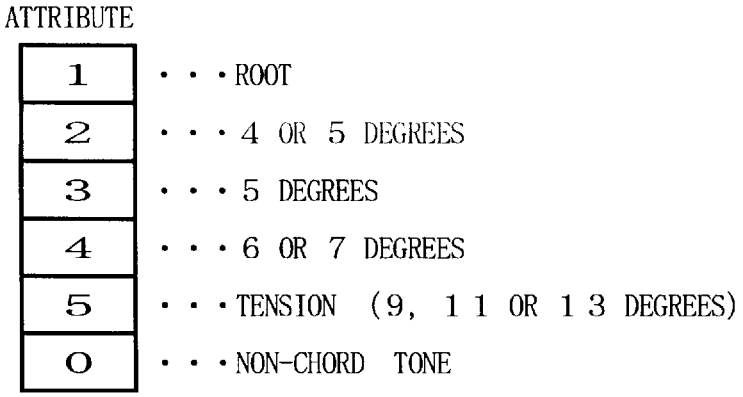
FIG. 2 is a diagram showing an example of corresponding relations between tone pitches and attributes in the embodiment of FIG. 1.

FIG. 2 is a diagram showing an example of basic corresponding relations between the relative pitches and attributes in the attribute table. In this example, the chord root is classified as attribute "1", the chord component note higher than the chord root by three or four degrees is classified as attribute "2", the chord component note higher than the chord root by five degrees is classified as attribute "3", the chord component note higher than the chord root by six or seven degrees is classified as attribute "4", and the chord component note higher than the chord root by nine, 11 or 13 degrees (the so-called "tension note" to be added to the top of the basis chord to additionally yield a kind of tension feeling to the chord's total sounding effect) is classified as attribute "5". Further, pitches that do not fall within the category of chord component notes or tension notes (hereinafter called "non-chord tones") are classified as attribute "0".

The corresponding relations between the relative pitches and attributes in the attribute table may be other than those shown in FIG. 2; for example, the chord components note higher than the chord root by three and four degrees, or six and seven degrees may each be classified as an independent attribute.

FIG. 3A to 3C are diagrams conceptually showing exemplary contents of the attribute table created on the basis of the corresponding relations illustrated in FIG. 2. FIG. 3A shows exemplary contents of the attribute table for a C major 7th chord, where note name C as the chord root is defined as attribute "1"; note name E, major third from note name C, is defined as attribute "2"; note name G, perfect fifth from note name C is defined as attribute "3", note name B, major seventh from note name C is defined as attribute "4"; and other notes denoted by black circle are defined as attribute "0" (non-chord tones). In the example of FIG. 3A, there is no note of attribute "5" (tension note).

FIG. 3B shows exemplary contents of the attribute table having note name D sharp, augment ninth from note name C, added to a C 7th chord as a tension note, where note name C as the chord root is defined as attribute "1"; note name E, major third from note name C, is defined as attribute "2"; note name G, perfect fifth from note name C, is defined as attribute "3"; note name B flat, minor seventh from note name C, is defined as attribute "4"; note name D sharp, augment ninth from from note name C, is defined as attribute "5"; and other notes denoted by black circle are defined as attribute "0" (non-chord tones).

FIG. 3C shows exemplary contents of the attribute table for a C 7th sus 4 chord, where note name C as the chord root is defined as attribute "1"; note name F, perfect fourth from note name C, is defined as attribute "2"; note name G, perfect fifth from note name C, is defined as attribute "3"; note name B flat, minor seventh from note name C, is defined as attribute "4", and other notes denoted by black circle are defined as attribute "0".

It should be obvious that an attribute table can be created for other chords than the ones shown in FIGS. 3A to 3B in generally the same manner on the basis of the theory of music. As a modification, only an attribute table for a given basic root (e.g., "C") may be stored, in which case, for another root than "C", the note names in the attribute table is shifted by an amount corresponding to the other root.

Which of the notes higher than the root by nine, 11 and 13 is most suitable for use as a tension note may vary depending on the scale and key. Thus, as an example, it is desirable that the tone pitch suitable for the scale be classified as attribute "5" (tension note), or a key be detected from a chord progression by use of a known key detection technique so as to classify the pitch suitable for the detected key as attribute "5". Further, pitches not suitable for use as tension notes in any one of plural sorts of scales and keys may be classified as attribute "0" (i.e., non-chord tones) in all the scales and keys.

The "open harmony table" is one which defines corresponding relations between the individual attributes in the attribute table and control contents, such as pitch and/or presence/absence of actual sounding (or tone volume), of the attributes. FIG. 4 shows several examples of corresponding relations between the individual attributes in the attribute table and the control contents. In open harmony table 1, "mute" (i.e., a process for generating no tone or lowering volume of a currently generated tone) corresponds to attribute "1", "through" (i.e., a process for generating a tone directly with no particular change made thereto) corresponds to attributes "2" and "3", "octave-down" (i.e., a process for generating a tone with its pitch lowered by an octave) corresponds to attribute "4", and "octave-up" (i.e., a process for generating a tone with its pitch raised by an octave) corresponds to attribute "5".

Further, in open harmony table 2, "through" corresponds to attributes "1" and "3", and "mute" corresponds to attributes "2", "4" and "5". In open harmony table 3, "octave-up" corresponds to attribute "2", and "through" corresponds to all the other attributes.

Note that because non-chord tones are by nature not sounded as chord component notes or tension notes, no particular control information on attribute "0" is contained in the open harmony tables.

It should be understood that the corresponding relations between the individual attributes in the attribute table and the control contents in the tables may be other than those shown in FIG. 4. In the ROM 4, there are prestored one or more sorts of such open harmony tables. Also, by activating the switches 9, the user is allowed to select desired control information, from among "mute", "through", "octave-up" and "octave-down", to be related to the individual attributes, to thereby create an open harmony table and write the thus-created table into the RAM 5.

Figure 5:
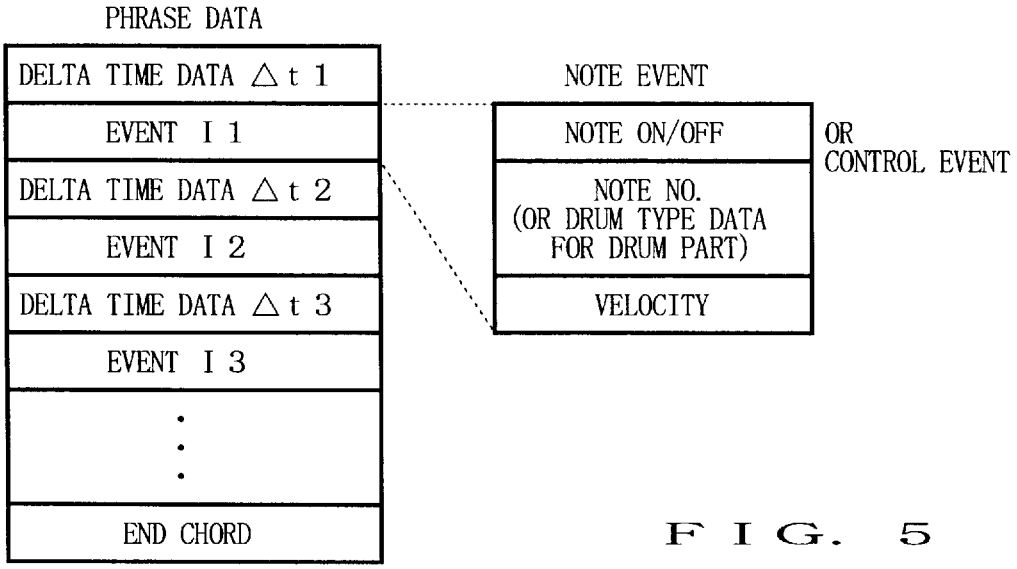
FIG. 5 is a diagram showing an exemplary format of phrase data in the embodiment of FIG. 1.

The "phrase data" is accompaniment pattern data having a basic unit length (which, for example, may correspond to the length of one or two measures) and created on the basis of a given chord. FIG. 5 shows an exemplary format of the phrase data. In this example, the phrase data is prepared in accordance with the so-called "event+relative time" format where the occurrence timing of each event is recorded with a relative time difference from that of a preceding event. Namely, in the illustrated example of FIG. 5, delta time data Δt1 indicative of a time elapsed from a start of the music piece is stored at the head address of the phrase data, and event I1 to occur at the timing indicated by the delta time data Δt1 is stored in the following storage area. Various events involved in the current embodiment includes a note event (note-on or note-off event) or control event (such as a tone volume change or pitch bend), a note number (or drum-type indicating data in the case of a drum part), and a velocity.

Delta time data Δt2 indicative of a relative time difference between the occurrence timing of event I1 and next event I2 is stored at the address following the storage area of event I1, and the event I2 to occur at the timing indicated by the delta time data Δt2 is stored in the following storage area. After that, delta time data and event are stored alternately in the above-mentioned manner, and an end code indicative of the end of the phrase data is stored at the last address. Note that the term "delta time" as used herein represents a relative time difference of adjacent events and each of the delta time data in this embodiment is recorded using "1" as a minimum unit time that represents the length of a 96th note. It should also be understood that the phrase data may separately contain data for each channel or may mixedly contain data for a plurality of channels. Further, while the example of FIG. 5 has been described as making the phrase data in the "event+relative time" format, the phrase data may be prepared in any other format commonly known in the art, such as: the "event +absolute time" format where the occurrence timing of each event is recorded with an absolute time elapsed from a start of the music piece; the "pitch+note length" format where pitch and length of every note are recorded; and the "solid" format where pitch data and tone generation controlling data, etc. are recorded in corresponding relation to every generating timing of the tempo clock pulse.

Figures 6, 7:
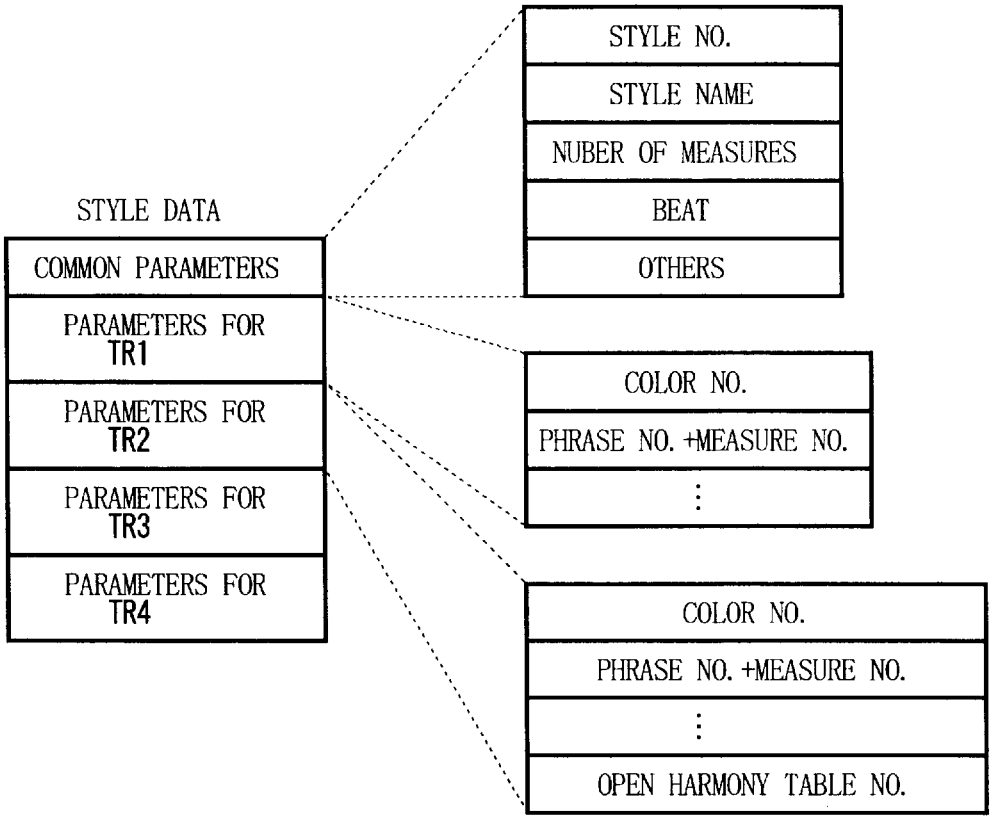
FIG. 6 is a diagram showing an exemplary format of style data in the embodiment of FIG. 1.
FIG. 7 is a diagram showing exemplary contents of the style data in the embodiment of FIG. 1.

Further, the "style data" represents accompaniment patterns to be reproduced in individual tracks TR1 to TR4. FIG. 6 shows an exemplary format of the style data, where the style data comprises common parameters stored for shared use by tracks TR1 to TR4 and unique parameters stored for use by individual tracks TR1 to TR4. The common parameters include a "style number" and "style name" of the style data, a particular "number of measures" forming a single repetition cycle of the style data, a "beat" of the style data, and other data.

The unique parameters stored for each of tracks TR1 to TR4 include a "tone color number" indicative of a tone color allocated to the track, one or more "phrase number+measure number" data indicating a specific phrase number of the phrase data to be reproduced for the track and a specific measure number where the reproduction of the phrase should start. In the illustrated example, the style data represents a combination of the phrase data as accompaniment patterns.

As still another feature of the present invention, the parameters for tracks TR2 to TR4 corresponding to the bass part and chord backing parts include "open harmony table numbers", each of which indicates a particular number of the open harmony table to be applied to the track in question. Note that for track TR1 corresponding to the drum part, such an "open harmony table number" is not included in the parameters because the process for effecting a pitch change or muting does not fit this track.

FIG. 7 conceptually shows exemplary contents of the style data. In the illustrated example, the number of measures is "4", and tone colors of drum, bass, piano and guitar are allocated to tracks TR1, TR2, TR3 and TR4, respectively. It is indicated here: for track TR1, reproduction of "number 1" phrase data having a length of one measure be started in the first measure for repetition up to the end of the fourth measure; for track TR2, reproduction of "number 2" phrase data having a length of one measure be started in the first measure for repetition up to the end of the fourth measure; for track TR3, reproduction of "number 3" phrase data having a length of one measure be started in the third measure for repetition up to the end of the fourth measure; and for track TR4, reproduction of "number 4" phrase data having a length of two measures be started in the first measure for repetition up to the end of the fourth measure. Also, the open harmony tables of numbers "2", "3" and "1" are designated for tracks TR2, TR3 and TR4, respectively. The accompaniment style is repeated with such a four-measure pattern as one cycle.

The style data stored in the ROM 4 include, in addition to the style data as shown in FIG. 7, other style data which has the same "phrase number+measure number" as the one of FIG. 7 but is different in the "open harmony table number" for one or more of tracks TR2 to TR4. Further, the user is allowed to enter optional open harmony table numbers for tracks TR2 to TR4 by activating the corresponding operating switches 9, in such a manner that a plurality of style data, having the same "phrase number+measure number" but differing from each other in the "open harmony table number", can be created and written into the RAM 5.

The "chord sequence data" is chord progression data comprising repetitions of delta time data and root and type of a chord that are recorded in predetermined order in accordance with the "event+relative time" format as with the phrase data of FIG. 5. The chord sequence data is used for a chord detection as a preliminary operation of an auto bass chord process as will be later described in detail. As an example, each of the delta time data is recorded using a minimum unit time of "1" that represents the length of one beat.

Referring back to FIG. 1, an external MIDI instrument, such as a synthesizer, can be connected to the electronic musical instrument via the MIDI interface 7 so that MIDI messages are exchanged between the two instruments. The external storage device 6 can record and reproduce, as phrase data, the MIDI message received via the MIDI interface 7; it also can reproduce software that comprises phrase data, style data and other automatic performance data prerecorded therein.

Although not specifically shown, the operating switches 9 include various switches for working the electronic musical instrument, some of which are for dedicated use in an automatic accompaniment of the present embodiment and may, for example, include the following switches:

(1) switches for entering and setting various parameters to create phrase data, style data and open harmony table (such as character-key switches and ten-key switches);

(2) switches for selecting style data to be reproduced (such as character-key switches and ten-key switches); and (3) start/stop switch for starting/stopping an automatic accompaniment.

The tone generator 11 receives, from a sequencer, data for the individual tracks (sequence and accompaniment pattern tracks) via the corresponding MIDI channels—for example, data for tracks TR1, TR2, TR3 and TR4 are received via MIDI channels of channel Nos. 1, 2, 3 and 4—, and on the basis of the received data, it generates tone waveform data (melody tone data and accompaniment tone data) simultaneously in a parallel fashion. As an example, the tone generator 11 may comprise a DSP (digital signal processor) which executes microprograms for tone generating processing. The tone waveform data generated by the tone generator 11 are transferred to the sound system 12 for audible reproduction thereof.

The tone generating method employed in the tone generator 11 may be any of the known waveform memory methods, such as the FM (frequency modulation) method, physical model method, harmonics synthesis method and formant synthesis method and the method simulating the functions of a VCO (voltage-controlled oscillator), VCF (voltage-controlled filter) and VCA (voltage-controlled amplifier) in an analog synthesizer. The tone generator 11 may be designed to share a single tone generating circuit among a plurality of tone generating channels on the time divisional basis or may include separate tone generating circuits for the individual tone generating channels.

Alternatively, the tone generator 11 may be implemented by the CPU 1 itself executing tone generating processing software, rather than by the DSP. As another example, an external tone generator device may be connected to the MIDI interface 7, with no tone generator incorporated in the electronic musical instrument, in such a manner that the data for the individual tracks are supplied to the tone generator device to generate tone waveform data.

Figure 8:
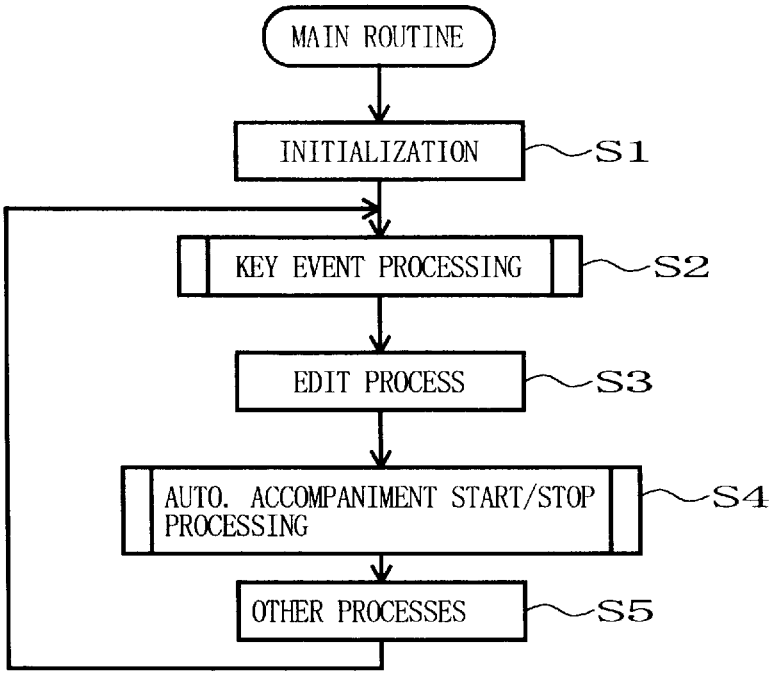
FIG. 8 is a flowchart illustrating a main routine executed by a CPU of FIG. 1.

Next, a description will be given below about examples of various processes executed by the CPU 1 with reference to FIG. 8 and subsequent figures. FIG. 8 is a flowchart illustrating a main routine executed by the CPU 1. In this main routine, after a predetermined initialization process of step S1, the CPU 1 repetitively performs "key event processing" of step S2, an "edit process" of step S3, "automatic accompaniment start/stop processing" of step S4 and "other processes" of step S5 in a steady loop.

Figure 9:
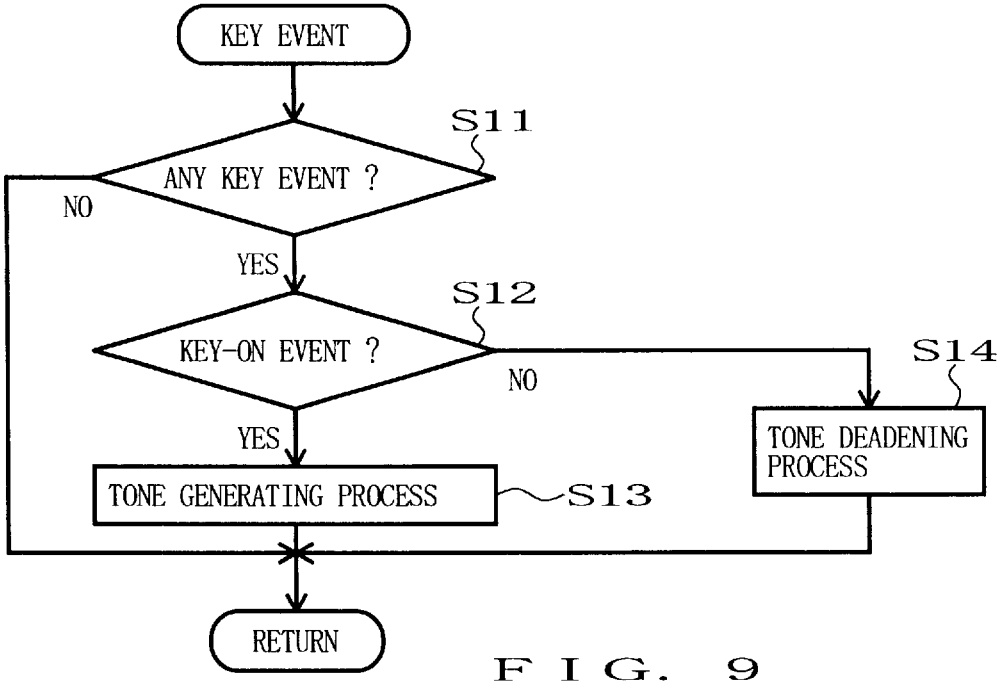
FIG. 9 is a flowchart showing a detailed example of key event processing of FIG. 8.

The "key event processing" of step S2 is conducted on the basis of a key event contained in a MIDI message received via the MIDI interface 7 or a MIDI message reproduced from the external storage device 6. As shown by way of example in FIG. 9, a determination is first made at step S11 as to whether or not occurrence of any key event has been detected. With a negative (NO) answer, the CPU 1 returns to the main routine, while with an affirmative answer, a further determination is made at step S12 as to whether the detected key event is a key-on event. If the detected key event is a key-on event as determined at step S12 (YES), the CPU 1 performs a predetermined tone generating process to generate a designated melody tone at step S13 and then returns. On the other hand, if answered in the negative at step S13, the CPU 1 performs a predetermined tone deadening process to mute a designated melody tone and then returns.

Referring back to FIG. 8, the edit process is a process for creating phrase data, style data or an open harmony table in accordance with user's operation of the corresponding operating switches 9 and write the thus-created data or table into the RAM 5. This edit process may be the same as a well-known process that is executed in an existing automatic accompaniment device to allow the user to create various data. However, because the style data contains an "open harmony number" as illustrated in FIG. 7, user's entry of a desired "open harmony table number" permits creation of a plurality of style data, which have the same "phrase number+measure number" but are different in the "open harmony table number" for one or more of tracks TR2 to TR4, to be written into the RAM 5.

The "automatic accompaniment start/stop processing" is a process for starting or stopping an automatic accompaniment in accordance with activation of the start/stop switch. In this automatic accompaniment start/stop processing, a determination is first made at step S21 as to whether or not there has occurred an on-event of the start/stop switch. With a negative answer (NO), the CPU 1 immediately returns to the main routine, while with an affirmative answer (YES), the value of automatic accompaniment flag RUN in the RAM 5 is inverted between values "1" and "0" at step S22, and it is then determined at step S23 whether or not the automatic accompaniment flag RUN is currently at the value of "1".

If answered in the affirmative at step S23, the CPU 1 proceeds to step S24 to set a value "0" as variable "m" that designates order of measures. Then, a read pointer for chord sequence data is set to point to the head address of the sequence data at step S25, so as to read out delta time data therefrom at step S26. At next step S27, the read-out delta time data is set into chord sequence data counter TIME, and then the program returns. On the other hand, if answered in the negative at step S23, i.e., if the automatic accompaniment flag RUN is currently at the value of "0", the processing branches to step S28 to effect a predetermined tone deadening process of an accompaniment tone being currently sounded.

If the start/stop switch is activated while the automatic accompaniment flag RUN is at "1", this automatic accompaniment start/stop processing changes the value of the flag RUN to "0", so that the automatic accompaniment is terminated. Conversely, if the start/stop switch is activated while the automatic accompaniment flag RUN is at "0" (i.e., while no automatic accompaniment is being performed), this automatic accompaniment start/stop processing changes the value of the flag RUN to "1", so that an automatic accompaniment is performed by the CPU 1 executing interrupt routines as shown in FIGS. 11 to 13.

Figure 11:
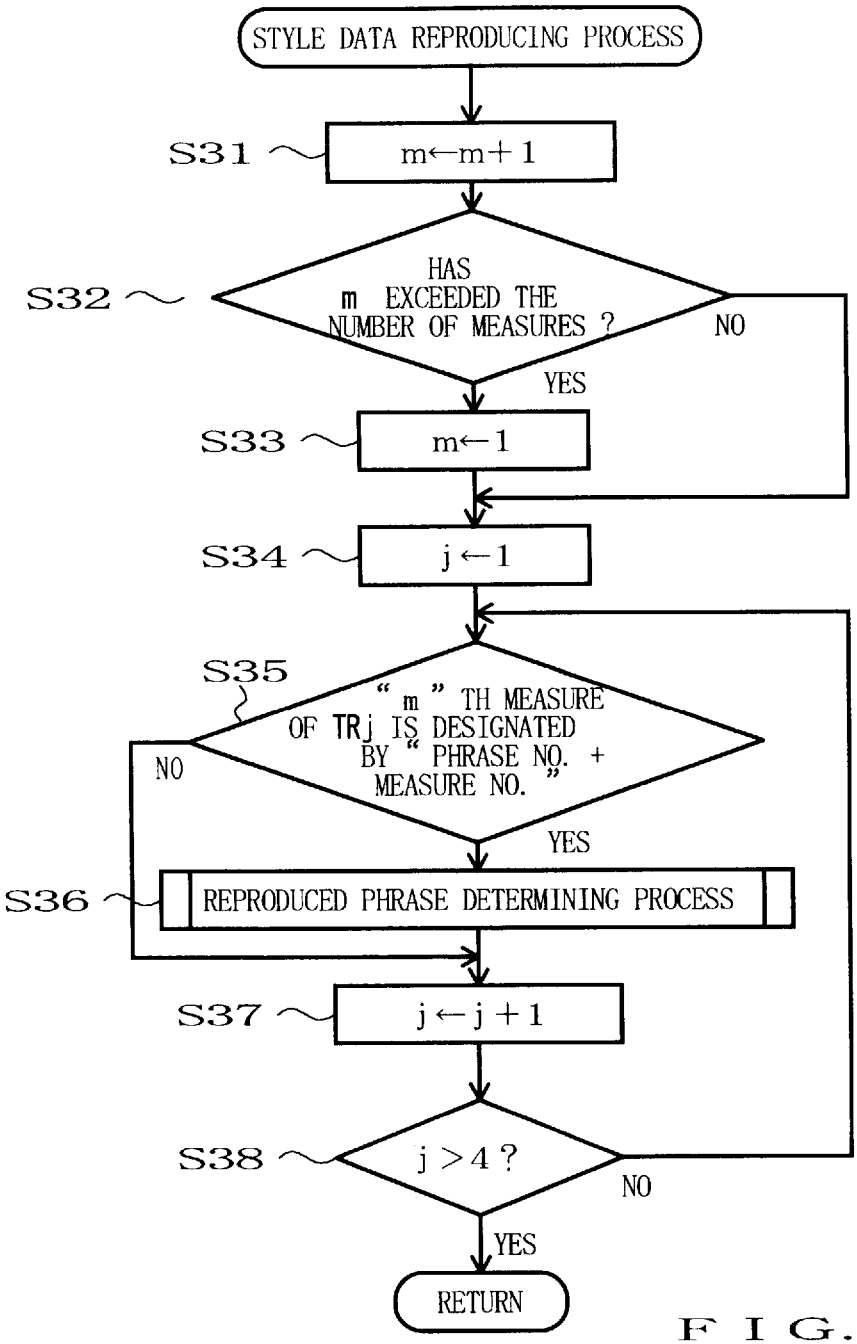
FIG. 11 is a flowchart showing an example of an interrupt process executed by the CPU of FIG. 1.

A "style data reproducing process" of FIG. 11 is a process for, on the basis of style data selected by the user, determining phrase data to be reproduced for each of tracks TR1 to TR4. This style data reproducing process is activated, once for every length of one measure, in response to a tempo clock pulse from the timer 2.

Figure 12:
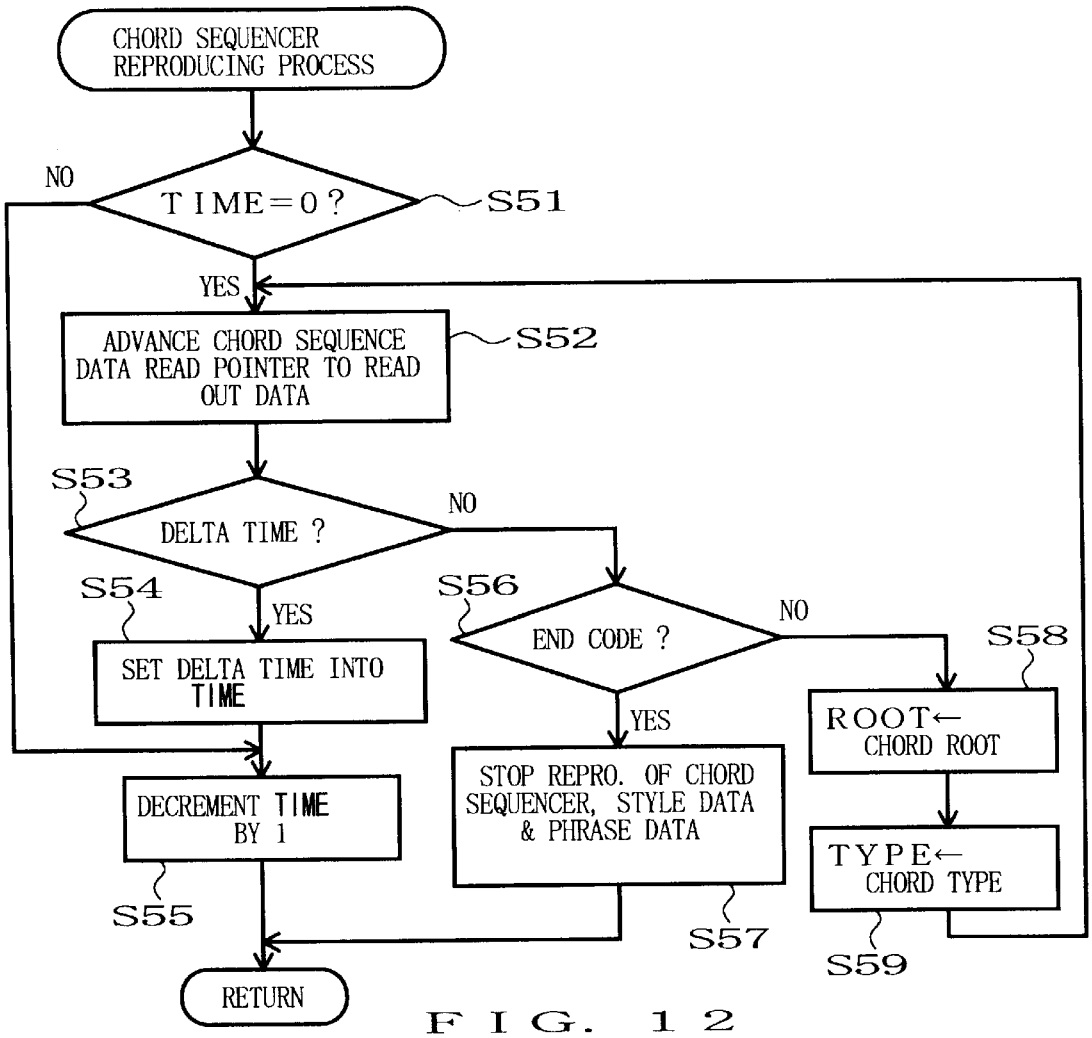
FIG. 12 is a flowchart showing an example of another interrupt process executed by the CPU of FIG. 1.

A "chord sequencer reproducing process" of FIG. 12 is a process for reproducing chord sequence data to detect a chord, and this process is activated, once for every length of one beat, in response to a tempo clock pulse from the timer 2. Thus, with four-four (4/4) time, the chord sequencer reproducing process is activated once for every length of a quarter note.

Figure 13:
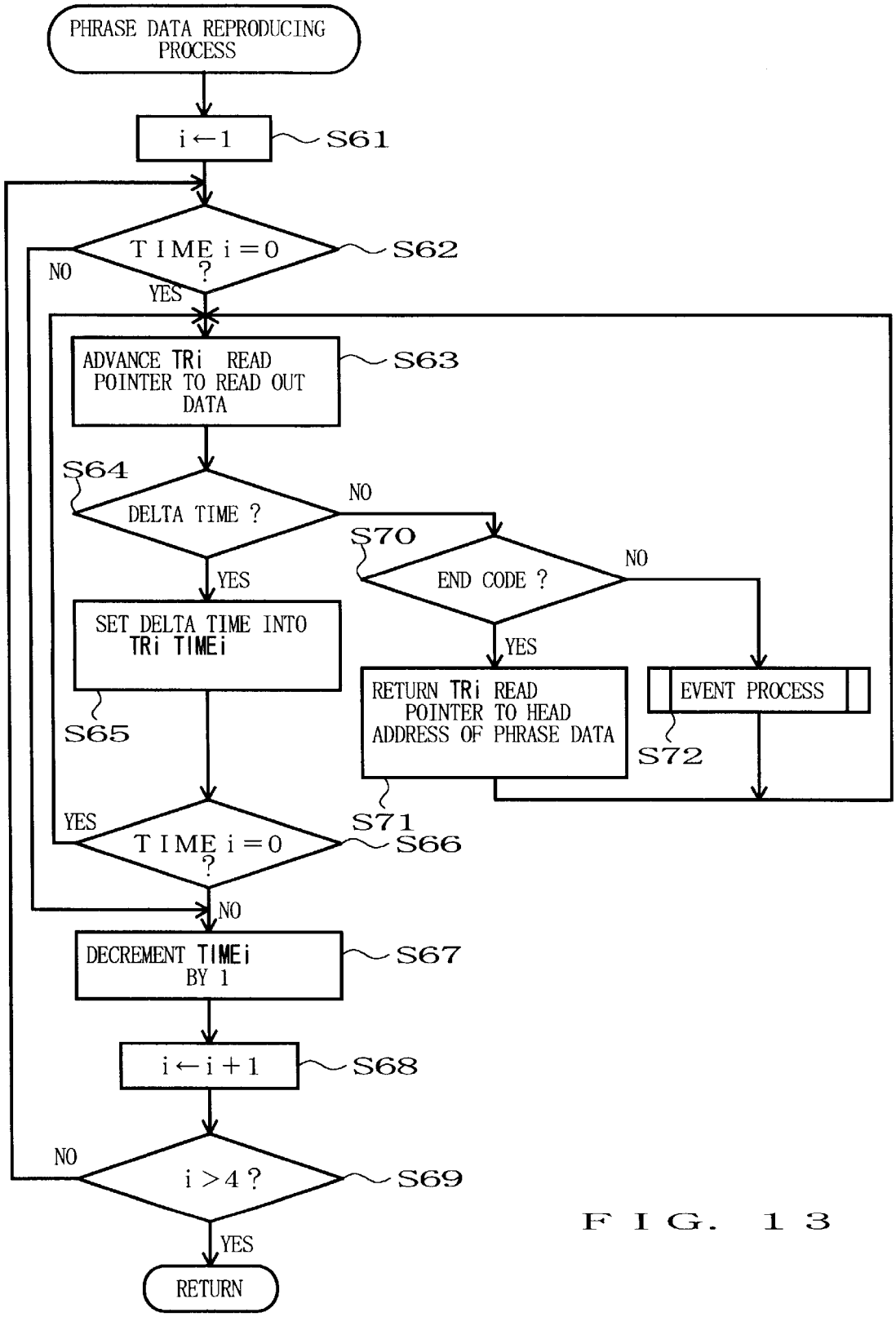
FIG. 13 is a flowchart showing an example of another interrupt process executed by the CPU of FIG. 1.

A "phrase data reproducing process" of FIG. 13 is a process for actually reproducing the phrase data that have been determined by the style data reproducing process to be reproduced in tracks TR1 to TR4. This phrase data reproducing process is activated once for every minimum unit time of delta time data contained in the phrase data (i.e., once for every length of a 96th note), in response to a tempo clock pulse from the timer 2.

By varying the tempo clock frequency, the processing frequencies of these processes can be changed to uniformly change reproduction tempo of the phrase data in all the tracks TR1 to TR4. Alternatively, the reproduction tempo of the phrase data in all the tracks TR1 to TR4 may be changed by varying a decrement of later-described counter TIME in the processes of FIGS. 12 and 13 to a value other than "1", or by multiplying delta time data to be stored in counter TIME by a value corresponding to the tempo.

Figure 10:
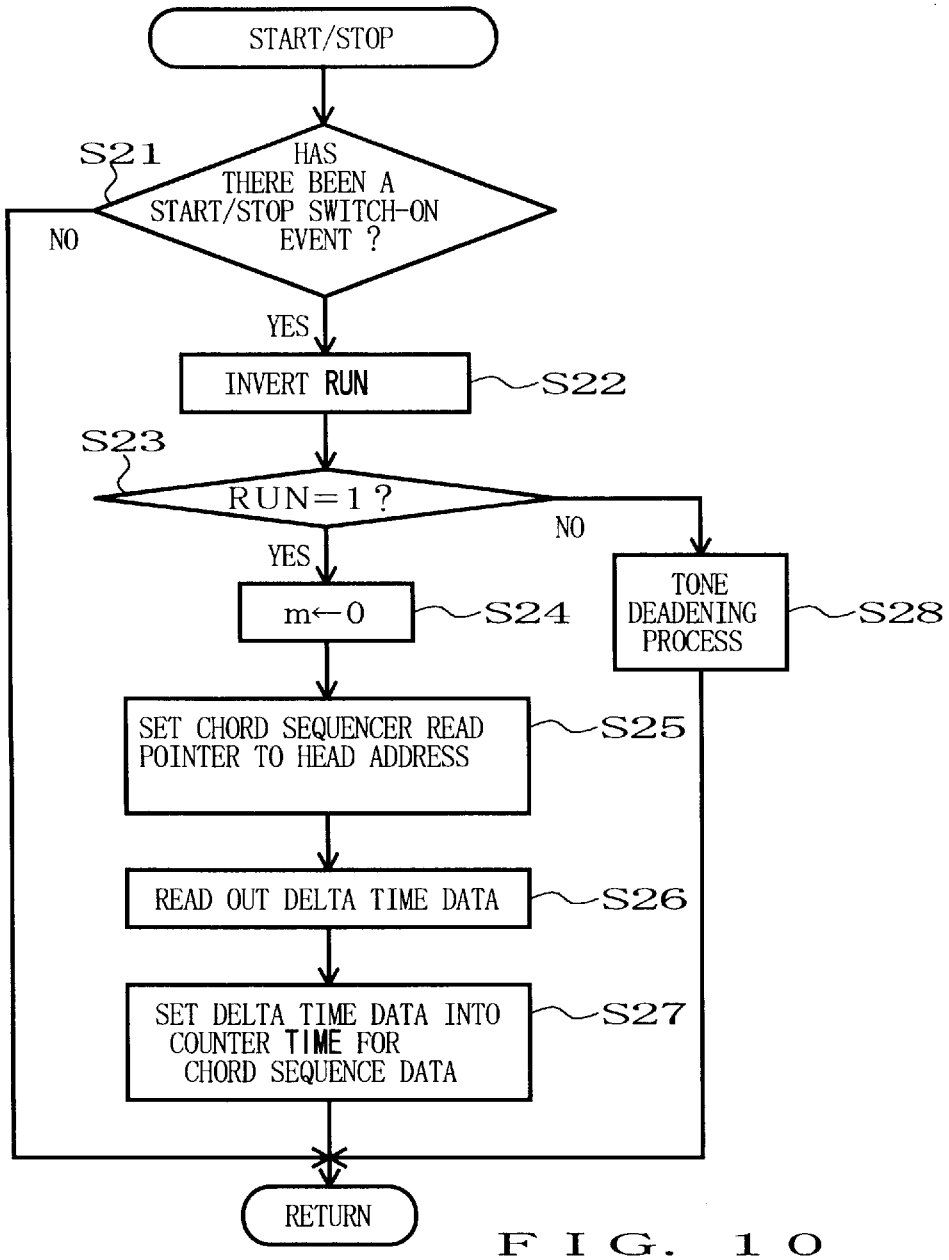
FIG. 10 is a flowchart showing a detailed example of automatic start/stop processing of FIG. 8.

In the "style data reproducing process" of FIG. 11, variable "m" designating order of measures, having been set to "0" at step S24 in the automatic accompaniment start/stop processing of FIG. 10, is incremented by one at step S31. Then, at step S32, a determination is made as to whether or not the value of variable "m" has exceeded the value of "number of measures" in the user selected style data ("4" in the example of FIG. 7). If answered in the negative, the CPU 1 jumps to step S34, while if answered in the affirmative, the CPU 1 proceeds to step S33 to set variable "m" to "1" and then to step S34. This way, the individual measures in the style data are sequentially designated in a repeated manner for every length of one measure.

At step S34, a value "1" is set into variable "j" designating any one of tracks TR1 to TR4. At next step S35, it is determined whether an "m"th measure of track TRj is the one designated by "phrase number+measure number" data (see FIG. 6) for track TRj contained in the style data, i.e., whether the "m"th measure is the one in which phrase data reproduction should be initiated.

If answered in the negative at step S35, the CPU 1 jumps to step S37. If answered in the affirmative, the CPU 1 goes to step S36 to execute a "reproduced phrase determining process" and then proceeds to step S37. In the reproduced phrase determining process at step S36, of respective read pointers of phrase data provided separately for individual tracks TR1 to TR4, the one for track TRj is set, at step S41, to point to the head address of the phrase data designated by the "phrase number+measure number". Then, delta time data Δt1 (see FIG. 5) is read out from the head address at step S42 and set into counter TIMEj for track TRj in the RAM 5 at step S43, after which the CPU 1 returns to the main routine.

Referring back to FIG. 11, at step S37, the value of variable "j" is incremented by one. At next step S38, a determination is made as to whether the current value of variable "j" is greater than "4", the number of tracks TR1 to TR4, i.e., whether the above-mentioned operations of the "m"th measure have been completed for all tracks TR1 to TR4. With a negative answer, the CPU 1 loops back to step S35 to repeat the operations of steps S35 to S38. After this, once an affirmative determination results at step S38, the CPU 1 returns to the main routine. By execution of the style data reproducing process for each of the measures, phrase data to be reproduced in the measure is determined for all tracks TR1 to TR4.

In FIG. 11, there is shown an example where a same combination of phrase data is determined, once for every number of measures (four measures in the example of FIG. 7) of the style data, as data to be repetitively reproduced. As a modification, a new combination of phrase data different from the previous one may be determined, as the data to be repetitively reproduced, in response to the user operating a style selecting switch or the like to newly select other style data. As another modification, instead of the user manually selecting style data, style sequence data to change style data along with progression of the music piece may be prestored in the ROM 4 or RAM 5 so that phrase data to be reproduced is determined on the basis of the style sequence data.

In the "chord sequencer reproducing process" of FIG. 12, a determination is first made at step S51 as to whether counter TIME is currently at a value "0". Counter TIME has been initially set to the value of the delta time data at step S27 of the "automatic accompaniment start/stop processing" shown in FIG. 10, and a negative determination results at step S51 as long as the value of the delta time data is equivalent to or greater than 1 (i.e., unless the detection timing of a first chord is concurrent with the start of the music piece), so that the process jumps to step S55 to decrement counter TIME by one and returns. If the first delta time data is of value "0" (i.e., if the detection timing of a first chord is concurrent with the start of the music piece), an affirmative determination results at step S51 so that the process proceeds to step S52.

At step S52, the read pointer of the chord sequence data is advanced, and data is read out from the address pointed to by the read pointer. At next step S53, it is determined whether or not the data read out at step S52 is delta time data. Since a chord root and type have been read out here, a negative answer is yielded at step S53 and the process branches to step S56 to further determine whether the data read out at step S52 is an end code. A negative answer is yielded also at this step S56 and the process branches to step S58.

The chord root is written into predetermined register ROOT in the RAM 5 at step S58, which is followed by step S59 where the chord type is written into predetermined register TYPE in the RAM 5. Then, the process loops back to step S52 to repeat the operations of steps S52 and S53. This time, the delta time data has been read out at step S52, and thus an affirmative determination results at step S53, so that the process proceeds to step S54 to set into counter TIME the data read out at step S52. After this, the process goes to step S55.

With these operations, a chord detection is effected every beat. Once the chord sequence data reaches an end code, an affirmative determination results at step S56, so that the process proceeds to step S57 to stop the chord sequencer reproducing process of FIG. 12, style data reproducing process of FIG. 11 and phrase data reproducing process of FIG. 13 and set flag RUN to "0". After this, the process returns.

Next, in the "phrase data reproducing process" of FIG. 13, a value "1" is set into variable "i" that designates one of tracks TR1 to TR4 at step S61. Then, at step S62, a determination is made as to whether counter TIMEi for designated track TRi is currently at a value "0".

Figure 14:
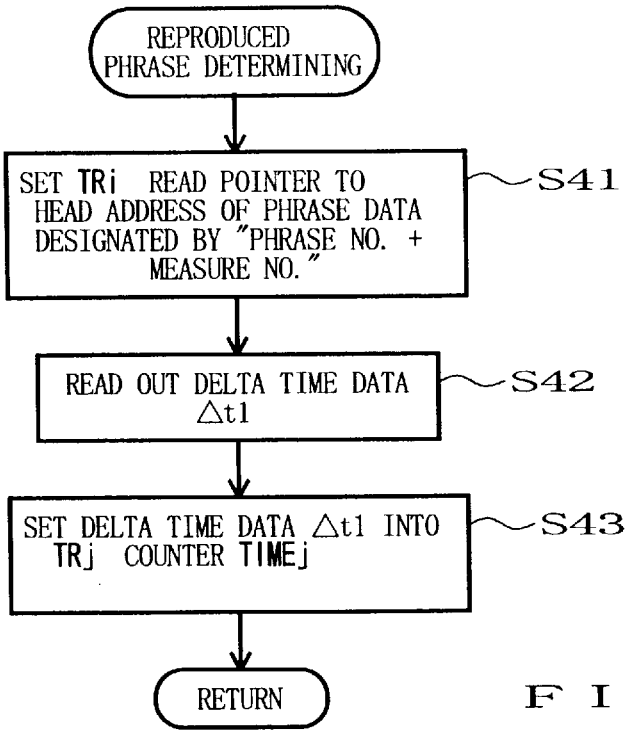
FIG. 14 is a flowchart showing a detailed example of a reproduced phrase determining process of FIG. 11.

At first, counter TIMEi is held at the value of the delta time data Δt1 set at step S43 of the reproduced phrase determining process shown in FIG. 14, a negative determination results at step S62 as long as the value of the delta time data Δt1 is equivalent to or greater than 1 (i.e., unless the timing of event I1 is concurrent with the start of the music piece), so that the process jumps to step S67 to decrement counter TIMEi by one. Then, variable "i" is incremented by one at step S68, and a determination is made at step S69 as to whether the current value of variable "i" is greater than "4", i.e., the number of tracks TR1 to TR4. With a negative answer, the process loops back to step S62. This way, a determination is made for each of tracks TR1 to TR4 as to whether counter TIME is currently at "0". If the current value of counter TIME is greater than "0" for each of tracks TR1 to TR4, an affirmative determination results at step S69 by way of steps S62, S67 to S69, and the process returns.

On the other hand, if the value of the delta time data Δt1 is "0" (i.e., if the timing of event I1 is concurrent with the start of the music piece) for any one of tracks TRi, or once counter TIME has reached "0" after several executions of the phrase data reproducing process (i.e., once the timing of event I1 has come), an affirmative determination results at step S62, so that the process proceeds to step S63.

At step S63, a read pointer for track TRi (initially set to point to the head address of phrase data at step S41 of the reproduced phrase determining process of FIG. 14) is advanced, and data is read out from the address currently pointed to by the read pointer. At next step S64, it is determined whether or not the data read out at step S63 is delta time data. Since event I1 has been read out here, a negative answer is yielded at step S64 and the process branches to step S70 to further determine whether the data read out at step S63 is an end code (FIG. 5). A negative answer is yielded also at this step S70 and the process branches to an "event process" of step S72.

Figure 15:
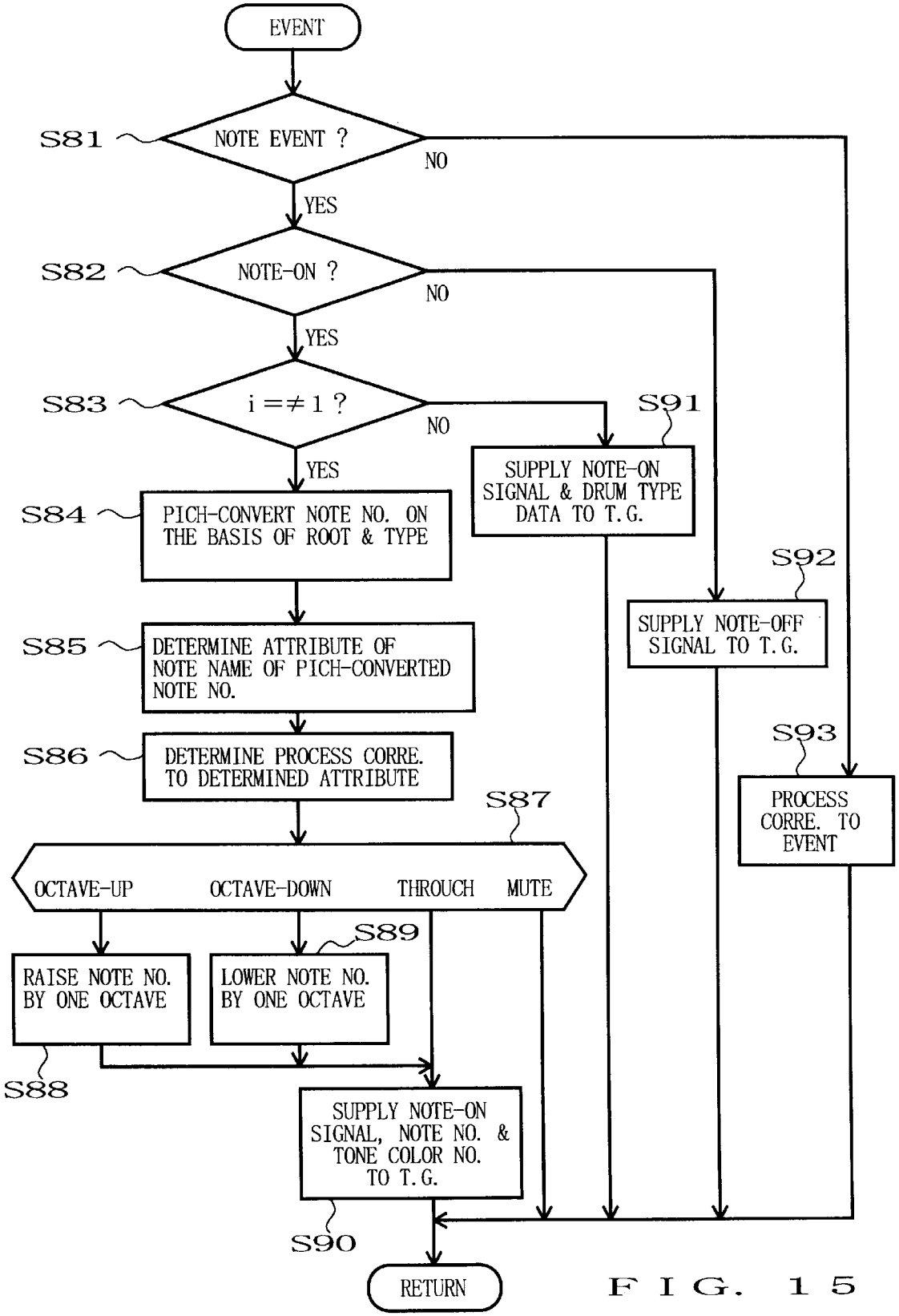
FIG. 15 is a flowchart showing a detailed example of an event process of FIG. 13.

In the event process, as shown in FIG. 15, a determination is first made at step S81 as to whether the event is a note event. If answered in the negative (i.e., if the event is a control event such as tone volume change or pitch bend), the process branches to step S93 to execute a process corresponding to that event and returns. On the other hand, if answered in the affirmative at step S81, the process proceeds to step S82 to ascertain whether the note event is a note-on event. With a negative answer (i.e., if the note event is a note-off event) at step S82, the process goes to step S92 in order to supply the note-off signal of the event to the tone generator 11 via any of the MIDI channels corresponding to track TRi.

If answered in the negative at step S83, the process branches to step S91, where the note-on signal and drum type data (note number) of the note event are supplied to the tone generator 11 via any of the MIDI channels corresponding to track TR1. After step S91, the process returns. With an affirmative answer at step S83, the process proceeds to step S84 for the so-called auto. bass chord process, where the note number of the note event is converted in pitch (pitch-converted) on the basis of the chord root and chord type which have been stored in registers ROOT and TYPE at steps S58 and S59 of the chord sequencer reproducing process of FIG. 12 initiated at corresponding timing. This pitch converting process is well known in the art and hence will not be described in detail here.

At next step S85, an attribute of the resultant pitch-converted note number is determined or identified with reference to the attribute table (FIG. 3) for the chord type stored in register TYPE. Following this, a sort of control to be effected for the determined attribute is determined, at step S86, with reference to the open harmony table designated by the open harmony table for track TRi contained in the style data. At next step S87, it is checked what the determined sort of control is. If the determined sort of control is "octave-up", the process goes to step S88 to raise the note number by one octave and then proceeds to step S90. If the determined sort of control is "octave-down", the process goes to step S89 to lower the note number by one octave and then proceeds to step S90. If the determined sort of control is "through", the process goes directly to step S90. In a modification, the note number may be raised or lowered by two octaves when the determined sort of control is "octave-up" or "octave-down". If the determined sort of control is "mute", the process directly returns without executing a data output process of step S90. As another example, when the determined sort of control is "mute", the velocity value contained in the note-on event may be reduced to cause the tone volume to become substantially zero, before the process goes to step S90 for the data output process.

Via the MIDI channel corresponding to track TRi, step S90 supplies the tone generator 11 with the note-on signal and note number (raised by one octave when step S88 has been taken, or lowered by one octave when step S89 has been taken) of the note event and "tone color data" for track TRi contained in the style data reproduced by the process of FIG. 11. After this, the process returns.

Referring back to FIG. 13, after step S72, the phrase data reproducing process loops back to step S63 so as to repeat the operations of step S63 and S64. This time, delta time data Δt2 (FIG. 5) is read out at step S63, so that an YES determination is yielded at step S64 and the process proceeds to step S65. At step S65, the delta time data At2 read out at step S63 is set into counter TIMEi for track TRi.

Then, it is determined at step S66 whether or not the current value of counter TIMEi is "0". An affirmative answer may result for the first and second chord backing parts when all component notes of the chord are to be sounded at the same timing and hence the timing of event I2 is the same as that of event I1, in which case the process loops back to step S63 to repeat the operations at and after step S63. On the other hand, if answered in the negative, i.e., if the timing of event I2 is later than that of event I1, the process goes to step S68 to execute the operations at and after step S68.

Then, once the phrase data has reached an end code (FIG. 5) in any of tracks TRi, an YES determination is yielded at step S70, so that the process goes to step S71 to return the read pointer for track TRi to the head address of the phrase data. Then, the process loops back to step S63 to repeat the operations at and after step S63.

By executing the above-described phrase data reproducing process once for every length of a 96th note, an automatic accompaniment performance is effected in tracks TR2 to TR4 while the pitch (octave) or presence/absence of sounding (or tone volume) of each chord component note is varied in accordance with the open harmony table designated by the open harmony table number.

Figure 16A:
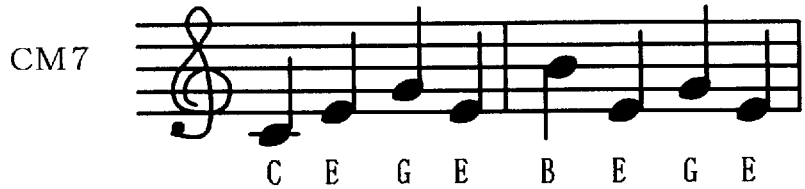
FIGS. 16A to 16E are diagrams showing exemplary manners in which component notes of phrase data are changed according to the principle of the present invention.
Figure 16B:
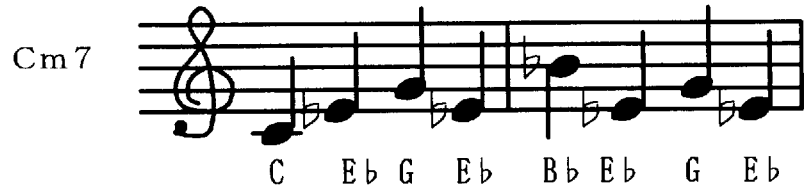
Figure 16C:
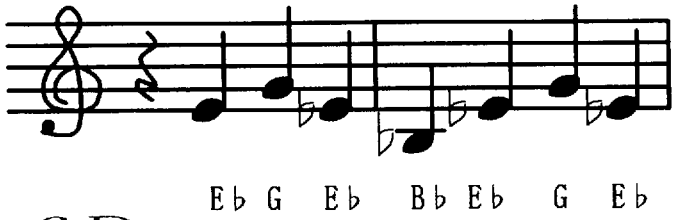

For the purpose of explanation, consider a situation where the phrase data for track TR2 corresponding to the bass part represents an accompaniment pattern that has a C major 7th chord as its basic chord as shown in FIG. 16A and where this accompaniment pattern has been pitch-converted, via the auto. bass chord process, into that of a C minor 7th chord as shown in FIG. 16B. In this situation, if the open harmony table designated by the open harmony table number for track TR2 is open harmony table 1 of FIG. 4, the accompaniment pattern of FIG. 16B is converted into another accompaniment pattern as shown in FIG. 16C and then performed, by the "C" note (root note) of attribute "1" being muted and the "B flat" note (seventh note) being lowered by one octave.

Figure 16D:
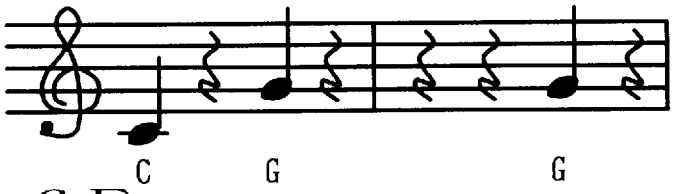
Figure 16E:
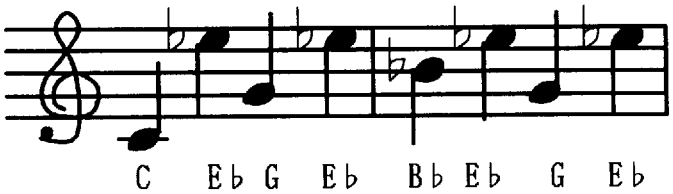

If the open harmony table designated by the open harmony table number for track TR2 is open harmony table 2 of FIG. 4, the accompaniment pattern of FIG. 16B is converted into another accompaniment pattern as shown in FIG. 16D and then performed, by the "E flat" note (third note) of attribute "2" and "B flat" note (seventh note) of attribute "4" being muted. Further, if the open harmony table designated by the open harmony table number for track TR2 is open harmony table 3 of FIG. 4, the accompaniment pattern of FIG. 16B is converted into another accompaniment pattern as shown in FIG. 16E and then performed, by the "E flat" note (third note) of attribute "2" being raised by one octave.

As typically shown in FIG. 16, an automatic accompaniment can be effected with different voicing on the basis of the same sort of phrase data, by selecting any one of a plurality of style data which have the same "phrase number+measure number" but differing from each other in the "open harmony table number" for one or more tracks TR2 to TR4.

With the above-described automatic accompaniment device, various variations of accompaniment performance are achieved on the basis of the same sort of accompaniment pattern data by controlling a tonal factor, such as tone pitch or volume, of accompaniment pattern data for each component note. As a result, voicing as desired by the user can be readily obtained from a relatively small number of accompaniment pattern data, which eliminates the need for preparing many sorts or groups of accompaniment pattern data for storage in the ROM 4 or RAM 5 as in the past, with the result that it is possible to effectively reduce the necessary time and labor for preparing the accompaniment pattern data and save storage space of the memory. Further, by just varying the open harmony table number for any of tracks TR2 to TR4 contained in the prestored style data, style data differing in accompaniment style from the prestored style data can be prepared, which thus greatly facilitates creation of new style data.

Furthermore, in the above-described embodiment, an attribute of each note number of phrase data is determined after the note number has been pitch-converted via the auto. bass chord process, so as to execute a process on a tone of note name corresponding to the determined attribute. Conversely, an attribute of each note number of phrase data may be determined to execute a process on before the auto. bass chord process.

Moreover, the embodiment has been described above as providing an attribute table for each chord type and effecting an attribute determination with reference to the attribute table. In a modification, each note event in phrase data may itself contain attribute information to classify the note name, represented by the note number, in terms of its attribute in such a manner that the attribute of the note name is determined on the basis of the attribute information. By so doing, the need can be eliminated for referring to a separate attribute table for every chord type, so that the attribute determination operation can be effected even more promptly.

Furthermore, in the above-described embodiment, the open harmony table number is stored as one parameter of style data. Alternatively, a plurality of open harmony table number data for tracks TR2 to TR4 may be stored, in the ROM 4 or RAM 5, as data separate from the style data so that a desired open harmony table can be designated by the user just selecting a desired one of the open harmony table number data. By so doing, a different accompaniment style can be obtained by just selecting one of open harmony table numbers even when the same style data is reproduced. This would effectively reduce the number of sorts of style data to be stored in the ROM 4 or RAM 5 and hence even further save storage space in the ROM 4 or RAM 5.

In the case where a plurality of the open harmony table number data are stored, the accompaniment device may be arranged in such a manner that the user's operation to change the open harmony table number data from one to another in the course of an automatic accompaniment permits designation of a corresponding other open harmony table. As another modification, sequence data to cause the open harmony table number data to change in accordance with progression of a music piece may be prestored in the ROM 4 or RAM 5 in such a manner that an open harmony table is designated on the basis of the sequence data.

Further, in the above-described embodiment, any of the mute, through, octave-up and octave-down operations corresponds to an attribute in the open harmony table. Alternatively, control of tone pitch or volume in other form, or control of another tonal factor than tone pitch or volume may be set to correspond to an attribute in the open harmony table and such control may be effected in the event process of FIG. 15. Furthermore, while the embodiment has been described as realizing the mute process by not executing the operation of step S90 of FIG. 10, the mute process may be effected by positively muting a generated tone signal after execution of step S90.

Moreover, in the above-described embodiment, the process on a tone of note name of each attribute is executed by preparing a plurality of open harmony tables defining correspondency between the individual attributes and changes in tone pitch or volume and selecting one of the thus-prepared tables. Alternatively, instead of preparing such open harmony tables, a desired one of changes in tone pitch or volume may be selected so that the process on a tone of note name of each attribute is executed on the basis of the selected change.

Furthermore, according to the above-described first embodiment, the style data expresses an accompaniment pattern as a combination of phrase data, such a form of the style data has the advantage that the same phrase data can be shared among different accompaniment styles. Alternatively, the style data may be formed to express, for each accompaniment part, an accompaniment pattern with accompaniment pattern data having a length of a plurality of measures (e.g., four measures)—in such a case, phrase data are not necessary.

Besides, the first embodiment has been described as applying the present invention to an automatic accompaniment device which carries out an automatic accompaniment by reproducing phrase data designated by style data. Alternatively, the present invention may be applied to an automatic accompaniment device which carries out an automatic accompaniment by reproducing accompaniment pattern data covering from a start to end of a music piece prestored in the ROM 4 or RAM 5. In this case as well, the attributive determination may be effected using the attribute table, or information indicative of an attribute of a note name identified by a note number may be included in a note event within the accompaniment pattern data in such a manner that the attributive determination is effected on the basis of the information.

Furthermore, while the first embodiment has been described as executing the process for changing tone pitch or volume with respect to the phrase data, such a process may be executed with respect to accompaniment pattern data entered from an external source into the automatic accompaniment device.

Moreover, in the above-described embodiment, the accompaniment parts consist of four parts: drum part; bass part; first chord backing part; and second chord backing part, and four tracks correspond to the four accompaniment parts. Alternatively, the present invention may of course be applied to an automatic accompaniment device which includes more or less than four accompaniment parts.

Furthermore, the first embodiment has been described above as applying the present invention to an automatic accompaniment device employed in a sequencer; however, the present invention may of course be applied to a keyboard-type electronic musical instrument (such as a synthesizer or electronic piano) or a percussion-instrument-type electronic musical instrument. As another modification, the present invention may of course be applied to not only an automatic accompaniment device comprising hardware circuitry but also an automatic accompaniment device comprising a personal computer and automatic accompaniment application software.

Next, a description will be given hereinbelow about another or second embodiment of the present invention, with reference to FIG. 17 and subsequent figures.

Figure 17:
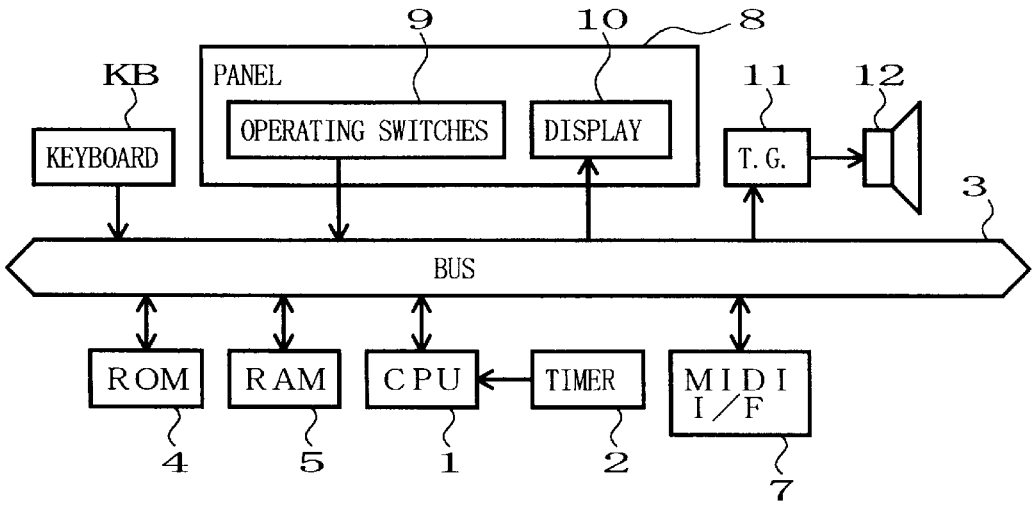
FIG. 17 is a block diagram illustrating a general hardware configuration of an automatic accompaniment device according to a second embodiment of the present invention.

In FIG. 17, the same reference characters as in FIG. 1 represent the same elements as in the figure; however, ROM 4 and RAM 5 in this embodiment store therein programs and data that are different from those stored in the counterparts of of the first embodiment. Further, the embodiment of FIG. 17 includes a keyboard KB for chord designation and melody performance, which may also be included in the embodiment of FIG. 1. Although not specifically shown in FIG. 17, this embodiment may also include the CD-ROM drive 14, external storage device 6 and communication interface 15 of the FIG. 1 embodiment.

In the ROM 4 of FIG. 17, there are stored programs descriptive of various processes to be executed by the CPU 1 and a plurality of sorts or groups of preset accompaniment pattern data for individual accompaniment parts (as an example, four accompaniment parts: drum part; bass part; first chord backing part; and second chord backing part). The RAM 5 includes areas for storing accompaniment pattern data created by the user for the individual accompaniment parts, as well as areas for use as a note order table, various registers and flags which will be described later in detail.

Figure 18:
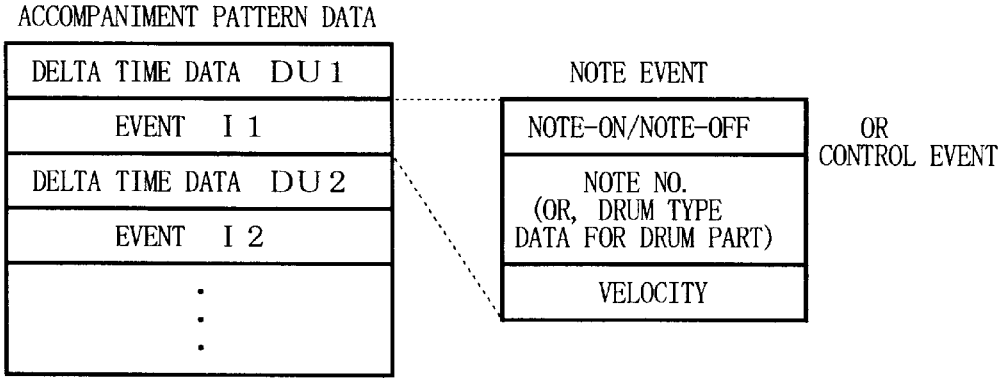
FIG. 18 is a diagram showing an exemplary format of accompaniment pattern data in the second embodiment.

FIG. 18 shows an exemplary format of the accompaniment pattern data. As in the example of FIG. 5, the accompaniment pattern data is prepared in accordance with the so-called "event+relative time" format where the occurrence timing of each event is recorded with a relative time difference from that of a preceding event. The accompaniment pattern data may be prepared in any other format known in the art, such as: the "event+absolute time" format; the "pitch+note length"; and the "solid" format.

On the keyboard KB of FIG. 17, a predetermined key range (e.g., a right key range) is used for a melody tone performance, while the remaining key area (left key range) is used for designating a chord progression.

Although not specifically shown, various operating switches 9 on an operation panel include switches for working the electronic musical instrument, some of which are for dedicated use in an automatic accompaniment of the present embodiment and may, for example, include the following switches:

(1) selection switches, such as character-key switches and ten-key switches, for selecting accompaniment pattern data to be read out from the ROM 4 or RAM 5;

(2) designation switch, such as a character-key switch, for designating a "shift direction" in which pitch of a component note of accompaniment pattern data should be shifted, an upward (plus or positive) direction or a downward (minus or negative) direction, as one important feature of the present invention;

(3) designation switches, such as ten-key switches, for entering a "shift number" designating one or more of component notes of accompaniment pattern data to be pitch-shifted. As an example, any optional one of natural numbers from "0" to "15" can be entered as such a shift number; and (4) start/stop switch for starting/stopping an automatic accompaniment.

In accordance with melody part performance information resulting from user's operation of the keyboard KB as well as performance information for the individual accompaniment parts resulting from execution of an automatic accompaniment, a tone generator 11 forms tone waveform data for these accompaniment parts simultaneously in a parallel fashion. The tone generator 11 may employ any of the known tone generating methods as noted earlier in relation to the first embodiment.

Figure 19:
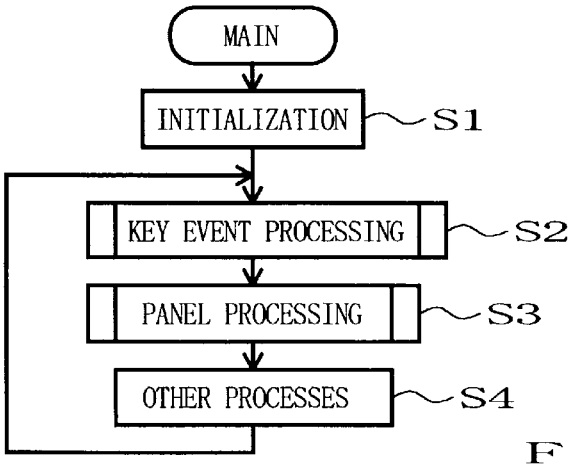
FIG. 19 is a flowchart illustrating a main routine executed by a CPU of FIG. 17.
Figure 20:
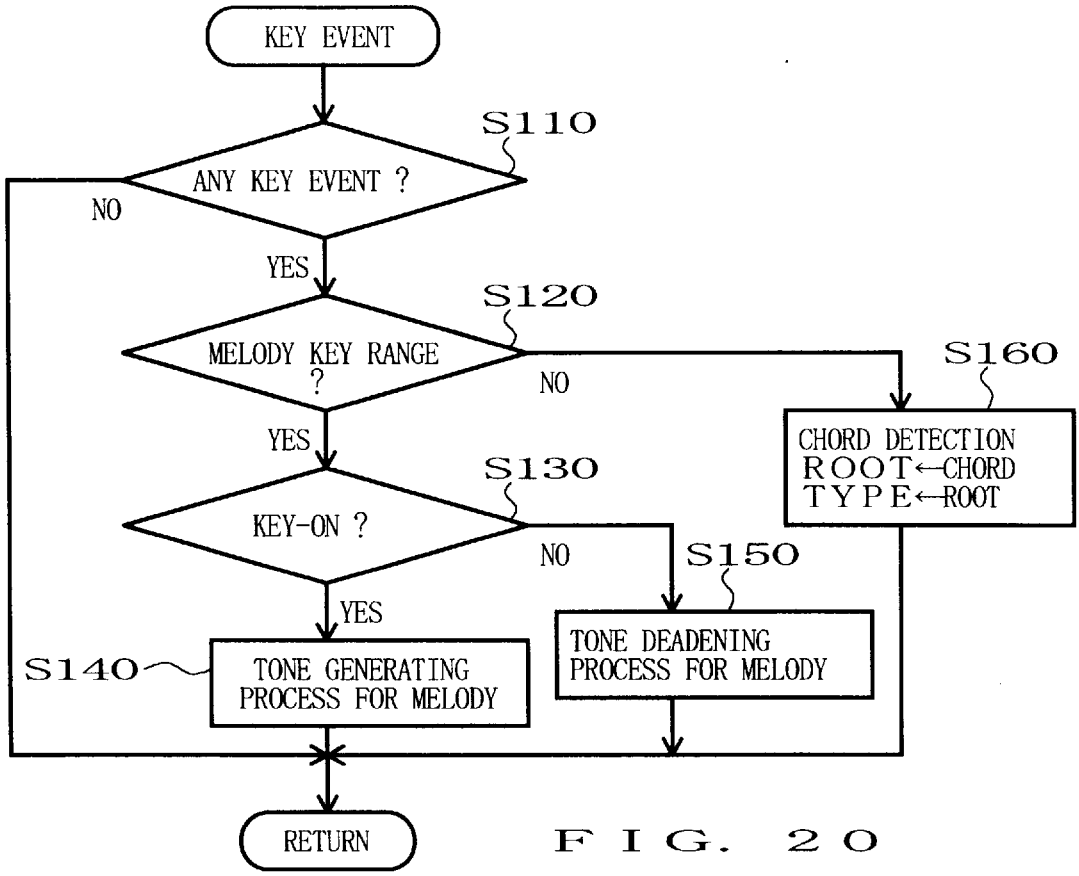
FIG. 20 is a flowchart showing a detailed example of key event processing of FIG. 19.

Next, a description will be given below about examples of various processes executed by a CPU 1 with reference to FIGS. 19 to 25. FIG. 19 is a flowchart illustrating a main routine executed by the CPU 1. In this main routine, after a predetermined initialization process of step S101, the CPU 1 repetitively performs "key event processing" of step S102, "panel processing" of step S103, and "other processes" of step S104 in a steady loop.

The "key event processing" of step S102 is conducted on the basis of a key event resulting from user's operation of the keyboard KB. As shown by way of example in FIG. 20, a determination is first made at step S110 as to whether or not occurrence of any key event has been detected. With a negative (NO) answer, the CPU 1 returns to the main routine, while with an affirmative answer, a further determination is made at step S120 as to whether the key event has occurred in the melody tone or right key range on the keyboard KB. If answered in the affirmative at step S120, the processing proceeds to step S130 to further determine whether the key event is a key-on event. If so, a predetermined tone generating process is performed, at step S140, on the melody tone on the basis of a key code etc. of the key event, and then the processing returns. If answered in the negative, i.e., if the key event is a key-off event as determined at step S130, a predetermined tone deadening process is performed, at step S150, to mute a designated melody tone and then the processing returns.

On the other hand, if answered in the negative at step S120, i.e., if the key event has occurred in the chord-progression designating or left key range on the keyboard KB, the processing branches to step S106 in order to detect a chord. The detected chord root and chord type are written into predetermined registers ROOT and TYPE, respectively, and then the processing returns. Note that instead of detecting the chord on the basis of the key event resulting from user's operation of the keyboard KB as in the example of FIG. 20, the chord detection may be conducted by reading out chord sequence data (i.e., data sequentially designating a chord progression from a start to end of a music piece) prestored in the RAM 5.

Figure 21:
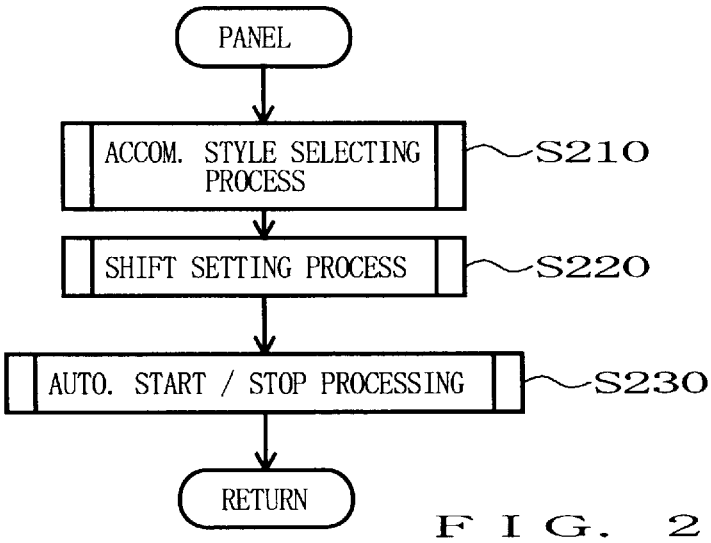
FIG. 21 is a flowchart showing a detailed example of panel processing of FIG. 19.

The panel processing at step S103 is conducted in response to user's activation of any of the operating switches 9. As illustrated in FIG. 21, this panel processing executes an "accompaniment style selecting process" of step S210, "shift setting process" of step S220 and "automatic accompaniment start/stop processing" of step S230.

The "accompaniment style selecting process" is intended for selecting accompaniment data for each of the accompaniment parts in response to user's operation of the corresponding selection switches; according to the present embodiment, a process for preparing a note order table is conducted after the accompaniment data selection. In this note-order-table preparing process, a note number is first extracted, at step S310, from each note event (see FIG. 18) in the selected accompaniment pattern data, for each of the bass part and chord backing parts. Then, the individual extracted note numbers are arranged in ascending order of tone pitch (i.e., from the one representing a lowest pitch to the one representing a highest pitch), and a note order table which defines correspondency between the note numbers and their allocated or given places in the order is created and written into the RAM 5 at step S320. After this, the individual extracted note numbers are arranged in descending order of tone pitch (i.e., from the one representing a highest pitch to the one representing a lowest pitch), and a note order table which defines correspondency between the note numbers and their given places in the order is created and written into the RAM 5 at step S330. Then, the process returns. This way, note order tables are prepared for each of the accompaniment parts.

FIGS. 26A to 26C show examples of the accompaniment pattern data and note order tables prepared on the basis of the accompaniment pattern data. More specifically, on the basis of the accompaniment pattern data created on the basis of a C major chord and having note names C3, E3 and G3 as shown in FIG. 26A, an ascending-order note order table is prepared which have note numbers representing note names C3, E3 and G3 in the first, second and third places, respectively, as shown in FIG. 26B and a descending-order note order table is prepared which have note numbers representing note names G3, E3 and C3 in the first, second and third places, respectively, as shown in FIG. 26C.

Referring back to FIG. 21, the "shift setting process" is intended for setting the shift direction and shift number for each of the accompaniment parts in response to user's operation of the corresponding switches.

Figure 23:
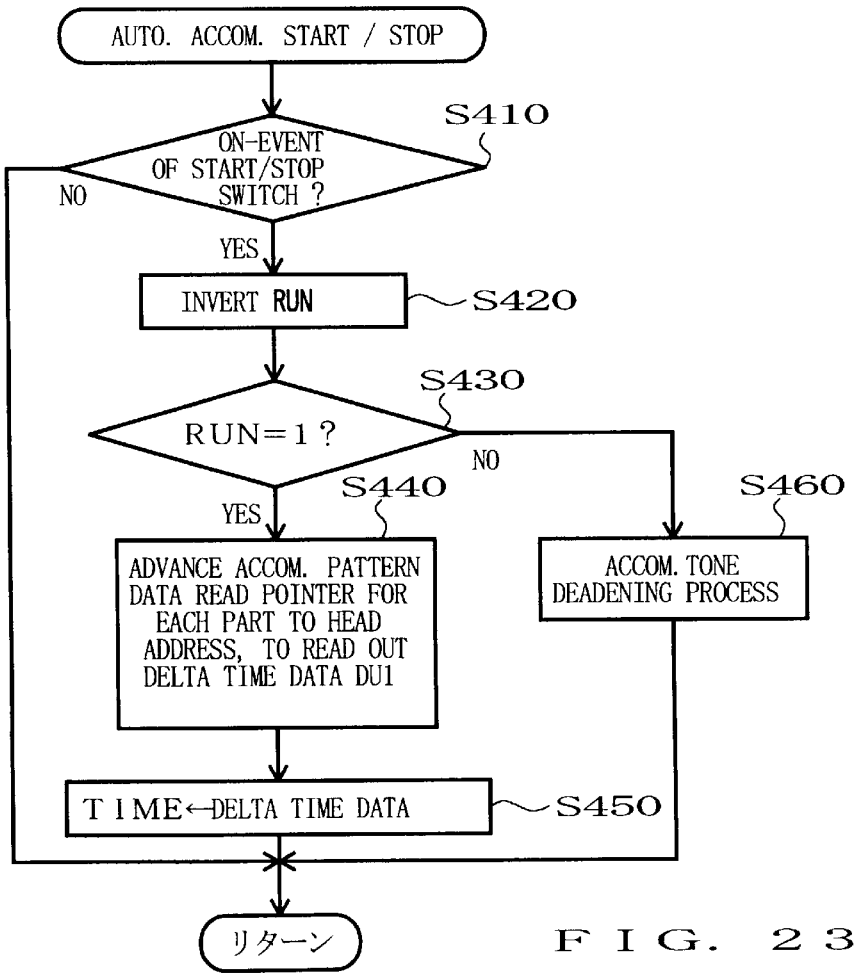
FIG. 23 is a flowchart showing an example of automatic accompaniment start/stop processing of FIG. 19.

The "automatic accompaniment start/stop processing" is executed in response to user's operation of the start/stop switch. In this process, as shown in FIG. 23, a determination is first made, at step S410, as to whether there has occurred an on-event of the start/stop switch. With a negative determination, the process returns, while with an affirmative determination, automatic accompaniment flag RUN in the RAM 5 is inverted between values "1" and "0" at step S420. After step S420, it is determined at step S430 whether or not the current value of automatic accompaniment flag RUN is "1". If answered in the affirmative at step S430, the processing proceeds to step S440, where a read pointer for accompaniment pattern data provided for each of the accompaniment parts is set to point to the head address of the accompaniment pattern data selected via the accompaniment style selecting processing, so as to read out delta time data DU1 (see FIG. 18) of the accompaniment part from the head address. At next step S450, the read-out delta time data DU1 is set into predetermined register TIME for the accompaniment part, and then the processing returns. If answered in the negative at step S430, i.e., if the automatic accompaniment flag RUN is currently at the value of "0", the processing branches to step S460 to effect a predetermined tone deadening process of an accompaniment tone being currently sounded.

If the start/stop switch is activated while the automatic accompaniment flag RUN is at "1", this automatic accompaniment start/stop processing changes the value of the flag RUN to "0", so that the automatic accompaniment is terminated. Conversely, if the start/stop switch is activated while the automatic accompaniment flag RUN is at "0" (i.e., while no automatic accompaniment is performed), this automatic accompaniment start/stop processing changes the value of the flag RUN to "1", so that an automatic accompaniment is performed by the CPU 1 executing interrupt routines as will be described below.

Figure 24:
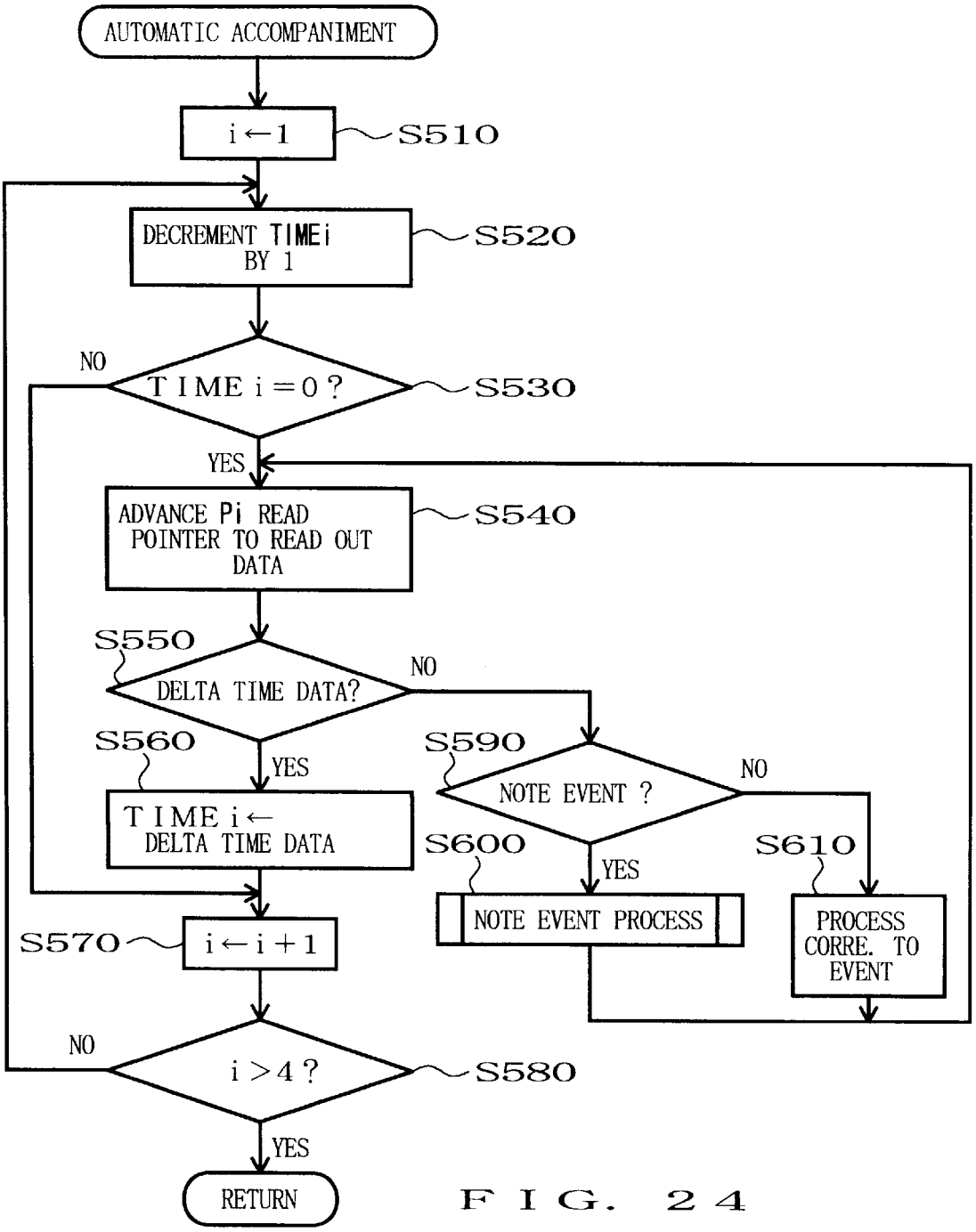
FIG. 24 is a flowchart showing an example of an interrupt process executed by the CPU of FIG. 17.

An automatic accompaniment process of FIG. 24 is activated every minimum unit time indicated by duration data in the accompaniment pattern data (see FIG. 18), on the basis of a tempo clock pulse from a timer 2. In this automatic accompaniment process, variable "i" designating a number of one of the accompaniment parts is set to "1" at step S510. After this, register TIMEi for the accompaniment part Pi is decremented by one at step S520, and a determination is made at step S530 as to whether or not the current value of register TIMEi is "o". With a negative answer, i.e., if the timing of event I1 for the accompaniment part Pi has not yet come, the process jumps to step S570 in order to increment variable "i" by one. At next step S580, a determination is made as to whether the current value of variable "i" is greater than "4", i.e., the number of accompaniment parts P1 to P4. With a negative answer, the process loops back to step S520 in order to repeat the operations of steps S520 and S530. This way, a determination is made, for each of the four accompaniment parts P1 to P4, as to whether counter TIMEi is currently at the value of "0". If the current value of counter TIMEi is not "0" all the four accompaniment parts P1 to P4, an affirmative determination results at step S580 and the process returns.

Once the current value of register TIMEi for any of the accompaniment parts Pi has reached "0", i.e., once the timing of event I1 for the accompaniment part Pi has come, an affirmative determination results at step S530, so that the process proceeds to step S540, where the read pointer for the accompaniment part Pi (having been initially set to point to the head address of the accompaniment pattern data at step S440 of the automatic accompaniment start/stop processing of FIG. 23) is advanced so as to read out data from the address currently pointed to by the read pointer. At next step S550, it is determined whether or not the data read out at step S540 is delta time data. Here, since event I1 has been read out, a negative answer is yielded and the process branches to step S590 to further determine whether the data read out at step S540 is a note event. If not, i.e., if the read-out data is a control event, the automatic accompaniment process branches to step S610 to carry out a process corresponding to the event. On the other hand, if answered in the affirmative, the automatic accompaniment process goes to step S600 for a "note event process" as will be described hereinbelow.

Figure 25:
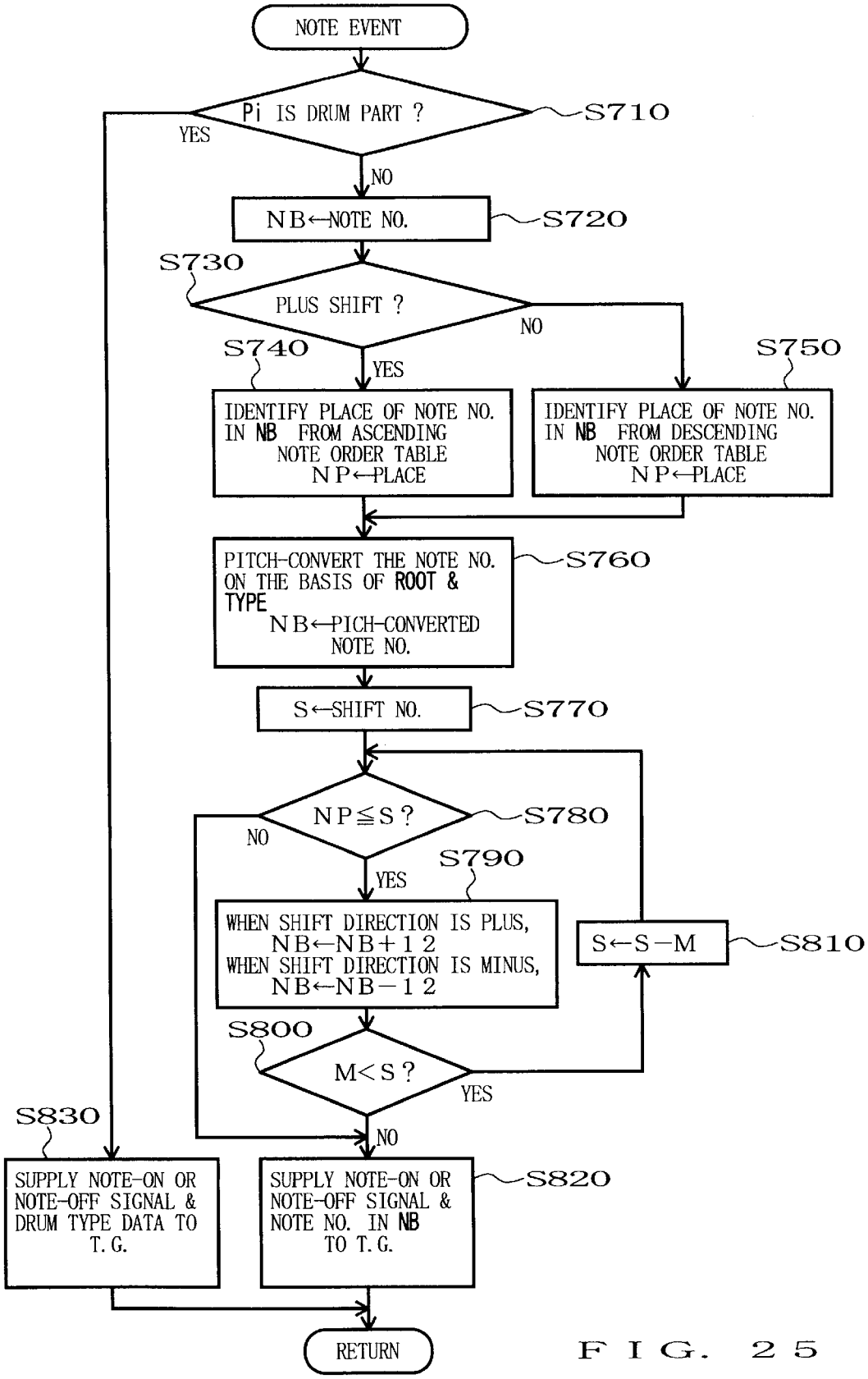
FIG. 25 is a flowchart showing a detailed example of a note event process of FIG. 24.

FIG. 25 is a flowchart showing an example of the note event process. In this example, a determination is first made at step S710 as to whether or not the accompaniment part Pi is the drum part. With an affirmative answer, the note event process proceeds to step S830 in order to output the note-on or note-off signal and drum type data of the event to the tone generator 11 and then returns. On the other hand, if a negative answer results at step S710, i.e., if the accompaniment part Pi is the bass or chord backing part, the process proceeds to step S720 in order to write the note number of the note event into predetermined register NB within the RAM 5. At next step S730, a determination is made at step S730 as to whether or not the shift direction having been set for the accompaniment part Pi through the shift setting process of FIG. 21 is the upward or plus direction.

Figure 22:
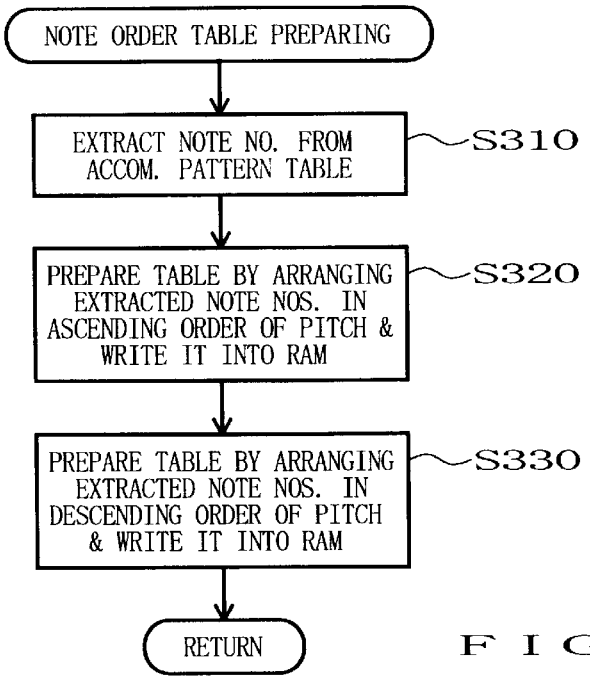
FIG. 22 is a flowchart showing an example of a note order table preparing process.

In answered in the affirmative at step S730, the process goes to step S740, where the place or turn of the note number in the note-order-table (i.e., the place of the note number in the ascending order of tone pitch in the accompaniment pattern data) is identified with reference to the ascending note order table prepared for the accompaniment part Pi through the process of FIG. 22 and written into predetermined register NP within the RAM 5.

In answered in the negative at step S730, i.e., if the shift direction is the downward or minus direction, the process branches to step S750, where the place or turn of the note number in the note-order-table (i.e., the place of the note number in the descending order of tone pitch in the accompaniment pattern data) is identified with reference to the descending note order table prepared for the accompaniment part Pi through the process of FIG. 22 and written into predetermined register NP within the RAM 5.

After step S740 or S750, the process proceeds to step S760, where the note number in register NB is pitch-converted on the basis of the chord root and chord type data in respective registers ROOT and TYPE through the auto bass chord process and the resultant pitch-converted note number is rewritten into register NB. At next step S770, the shift number currently set for the accompaniment part Pi through the shift setting process of FIG. 21 is written into predetermined register S within the RAM 5. After this, a determination is made at step S780 as to whether the current shift number in register S is equivalent to or greater in value than the place now set in register NP.

If the shift direction has been determined to be the plus direction, possible examples of the determination result at step S780 will be as follows in the case of the accompaniment pattern data of FIGS. 26A to 26C:

(1) When the shift number is "1":

If the note number is the one representing a tone pitch of "C3", an affirmative determination results now that the value of the place currently written in register NP is "1". If the note number is the one representing a tone pitch of "E3" or "G3", a negative determination results now that the value of the place currently in register NP is "2" or "3";

(2) When the shift number is "2":

If the note number is the one representing a tone pitch of "C3" or "E3", an affirmative determination results now that the value of the place currently written in register NP is "1" or "2". If the note number is the one representing a tone pitch of "G3", a negative determination results now that the value of the place currently in register NP is "3";

(3) When the shift number is "3":

An affirmative determination results now that the value of the place currently written in register NP is "1", "2" or "3" no matter which one of tone pitches "C3", "E3" and "G3" the note number represents.

On the other hand, if the shift direction has been determined to be the minus direction, possible examples of the determination result at step S780 will be as follows in the case of the accompaniment pattern data of FIGS. 26A to 26C:

(4) When the shift number is "1":

If the note number is the one representing a tone pitch of "G3", an affirmative determination results now that the value of the place currently written in register NP is "1". If the note number is the one representing a tone pitch of "C3" or "E3", a negative determination results now that the value of the place currently in register NP is "3" or "2";

(5) When the shift number is "2":

If the note number is the one representing a tone pitch of "G3" or "E3", an affirmative determination results now that the value of the place currently written in register NP is "1" or "2". If the note number is the one representing a tone pitch of "C3", a negative determination results now that the value of the place currently in register NP is "3"; and (6) When the shift number is "3":

An affirmative determination results now that the value of the place currently written in register NP is "1", "2" or "3" no matter which one of tone pitches "G3", "E3" and "C3" the note number represents.

If answered in the negative at step S780, i.e., if the current shift number in register S is not equivalent to or greater in value than the place now set in register NP, the note event process jumps to step S820. If answered in the affirmative at step S780, the note event process moves on to step S790. At step S790, "12" is added to the value of the note number written in register NB, i.e., the pitch of the note number is raised by one octave when the shift direction is the plus direction, or "12" is subtracted from the value of the note number written in register NB, i.e., the pitch of the note number is lowered by one octave when the shift direction is the minus direction. The addition or subtraction result is then written into register NB. As another example of step S790, "24" or "36", rather than "12", may be added to or subtracted from the value of the note number written in register NB, so as to raise or lower the pitch of the note event by two or three octaves. Which of the values "12", "24" and "36" should be added to or subtracted from the value of the note number may be optionally determined by user's operation of the corresponding operating switches 9.

At next step S800, a determination is made as to whether or not the shift number in register S is greater in value than the highest place M in the note order table. In the case of the accompaniment pattern data of FIGS. 26A to 26C, the determination at step S800 will become negative if the shift number is three or less but will become affirmative if the shift number is four or more, because the highest place M in the note order table is "3".

If answered in the negative at step S800, i.e., if the shift number in register S is greater in value than the highest place M, the note event process proceeds to step S820; if answered in the affirmative at step S800, the process branches to step S810, where the value of the place M is subtracted from the shift number written in register S and the subtraction result is rewritten into register S. After this, the process reverts to step S780 in order to repeat the operations of steps S780 to S800 until a negative determination results at step S800. At step S820, the note-on or note-off signal and note number in register NB are supplied to the tone generator 11. Then, the process returns.

Figure 27A:
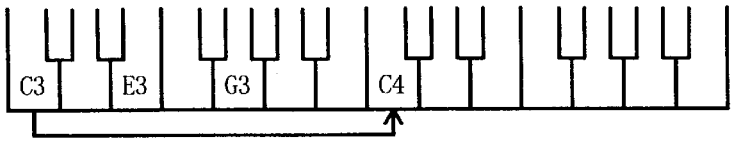
FIGS. 27A to 27I are diagrams showing how pitches of component notes of accompaniment pattern data are shifted.
Figure 27B:
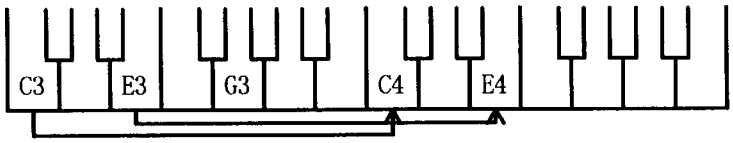
Figure 27C:
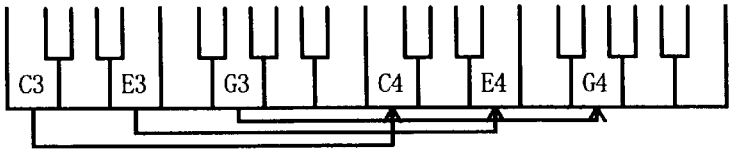
Figure 27D:
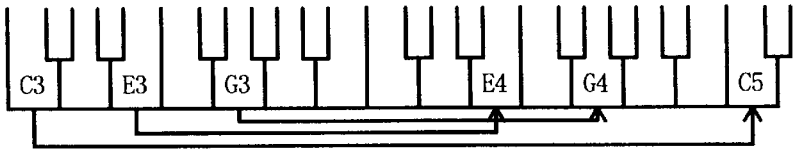
Figure 27E:
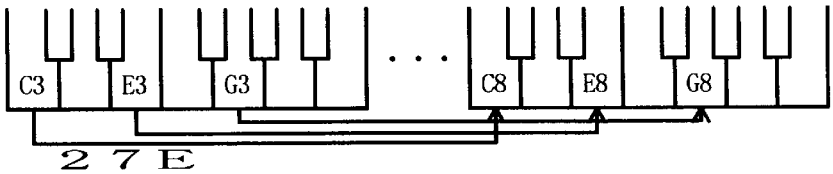
Figure 27F:
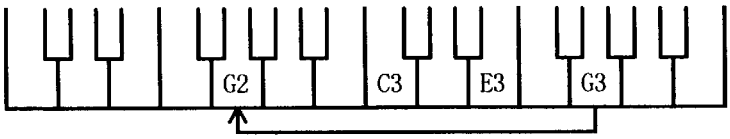
Figure 27G:
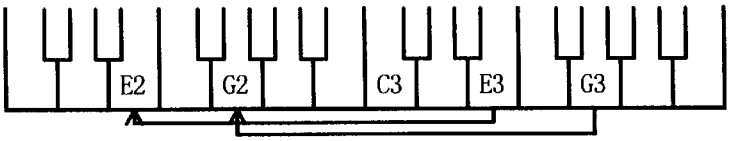
Figure 27H:
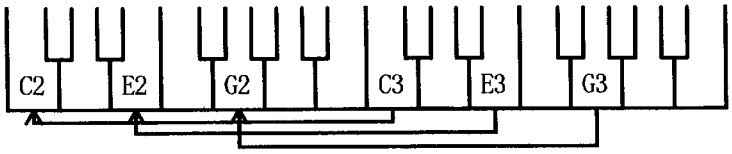
Figure 27I:
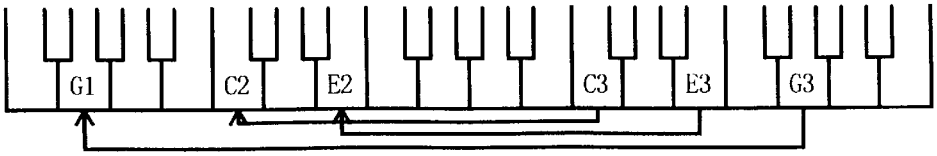

In the case of the accompaniment pattern data of FIGS. 26A to 26C, a manner in which the tone pitch is shifted through the operations of steps S780 to S800 will be as follows:

(1) When the shift direction is the plus direction and the shift number is "1":

The component note of pitch "C3" is shifted to pitch "C4" as shown in FIG. 27A;

(2) When the shift direction is the plus direction and the shift number is "2":

The component notes of pitches "C3" and "E3" are shifted to pitches "C4" and "E4", respectively, as shown in FIG. 27B;

(3) When the shift direction is the plus direction and the shift number is "3":

The component notes of pitches "C3", "E3" and "G3" are shifted to pitches "C4", "E4" and "G4", respectively, as shown in FIG. 27C;

(4) When the shift direction is the plus direction and the shift number is "4":

The component notes of pitches "C3", "E3" and "G3" are shifted to pitches "C5", "E4" and "G4", respectively, as shown in FIG. 27D;

(5) When the shift direction is the plus direction and the shift number is "15":

The component notes of pitches "C3", "E3" and "G3" are shifted to pitches "C8", "E8" and "G8", respectively, as shown in FIG. 27E;

(6) When the shift direction is the minus direction and the shift number is "1":

The component note of pitch "G3" is shifted to pitch "G2" as shown in FIG. 27F;

(7) When the shift direction is the minus direction and the shift number is "2":

The component notes of pitches "E3" and "G3" are shifted to pitches "E2" and "G2", respectively, as shown in FIG. 27G;

(8) When the shift direction is the minus direction and the shift number is "3":

The component notes of pitches "C3", "E3" and "G3" are shifted to pitches "C2", "E2" and "G2", respectively, as shown in FIG. 27H; and (4) When the shift direction is the minus direction and the shift number is "4":

The component notes of pitches "C3", "E3" and "G3" are shifted to pitches "C2", "E2" and "G1", respectively, as shown in FIG. 27I.

Referring back to step 24, after the note event process of step S600 or step S610, the automatic accompaniment process loops back to step S540 to repeat the operations of steps S540 and S550. This time, delta time data DU2 is read out at step S540, so that an affirmative determination results at step S550 and the process goes to step S560. At step S560, the delta time data read out at step S540 is written into register TIMEi for the accompaniment part Pi. Then, the process proceeds to step S570 to execute operations at and after step S570.

For the bass part and chord backing part, the above-described automatic accompaniment process affords the benefit that, by varying the shift direction or shift number by activation of the corresponding operating switches, any desired one of component notes in accompaniment pattern data can be shifted in a desired direction by one or more octaves, even in the course of an automatic accompaniment, to thereby give a desired range and sounding effect.

FIG. 28 is a block diagram showing the automatic accompaniment device of FIG. 17 in terms of its automatic accompaniment function. Note order table preparing section B (corresponding to the CPU 1 of FIG. 17) prepares a note order table C on the basis of accompaniment pattern data stored in accompaniment pattern storage section A (corresponding to the ROM 4 or RAM 5 of FIG. 17). Control section D (corresponding to the CPU 1 of FIG. 17) pitch-converts the accompaniment pattern data read-out from the note order table preparing section B on the basis of chord information supplied from chord information supply section E (corresponding to the keyboard KB of FIG. 17), and then, in accordance with an instruction from shift instructing section F (corresponding to the operating switches 9), the section D pitch-converts each component note of the pattern data with reference to the note order table C. Then, on the basis of the accompaniment pattern data with each component note pitch-converted, tone generator G executes the tone generating process to supply generated waveform data to sound system H (corresponding to the sound system 12 of FIG. 17).

Next, a description will be given below about modifications of the processes executed by the CPU 1 in the automatic accompaniment device of the present invention, with reference to FIGS. 29 and 30. According to the modifications, the following key event processing and note event process are executed in place of those described earlier in relation to FIG. 20 and 25.

Figure 29:
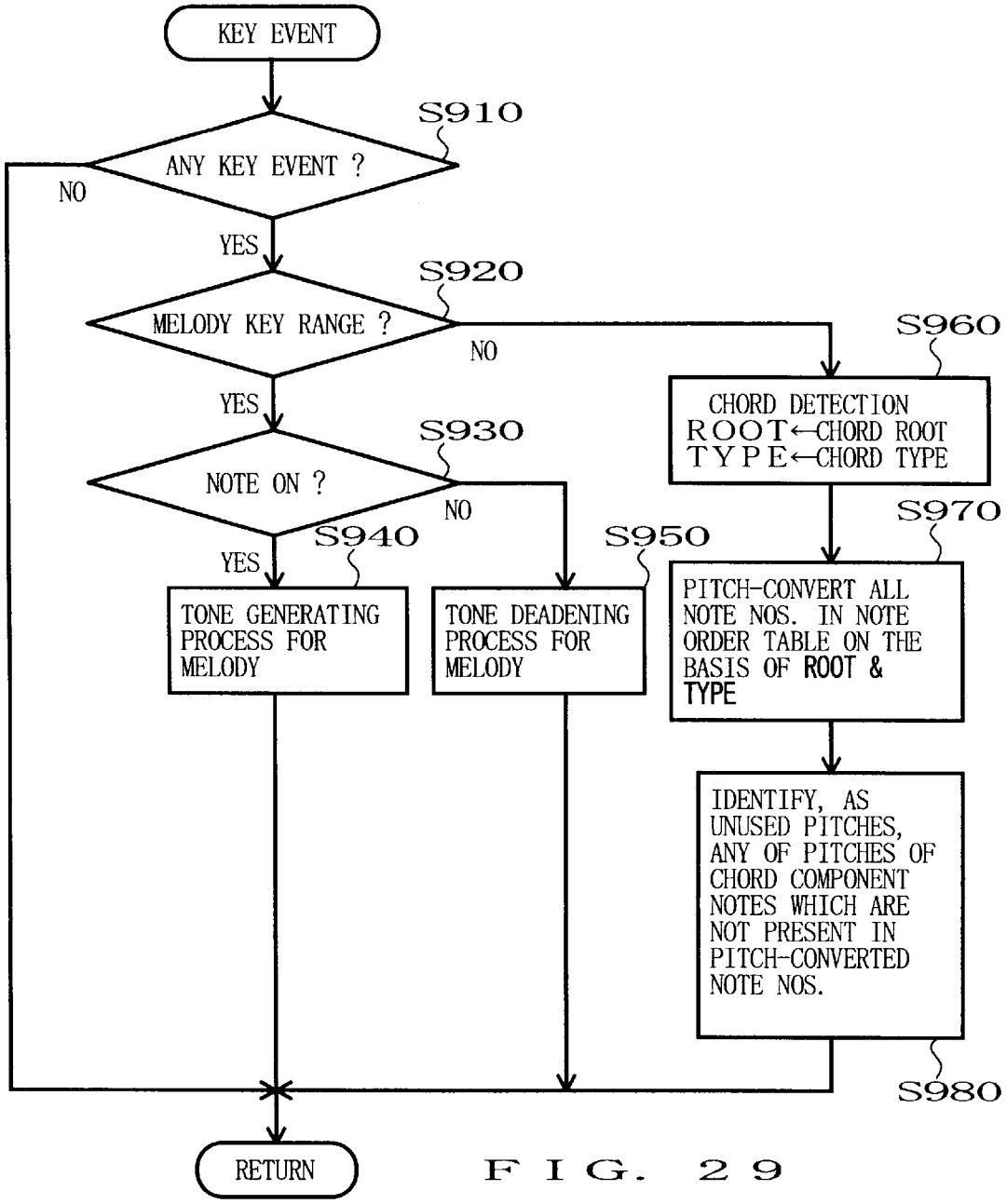
FIG. 29 is a flowchart showing a modification of the key event processing.

FIG. 29 is a flowchart showing the modified key event processing. First, after execution of operations of steps S910 to steps S960 similar to step S160 of the key event processing of FIG. 20, all the note numbers in the note order table prepared by the accompaniment style selecting processing are pitch-converted on the basis of the chord root and chord type data currently written in registers ROOT and TYPE. At step S980, such note numbers representing the pitches, among those of the chord component notes designated by the chord type data, which are not present in the note numbers pitch-shifted at step S970 (i.e., unused pitches) are identified, and the thus-identified note numbers are tabled.

Figure 31:
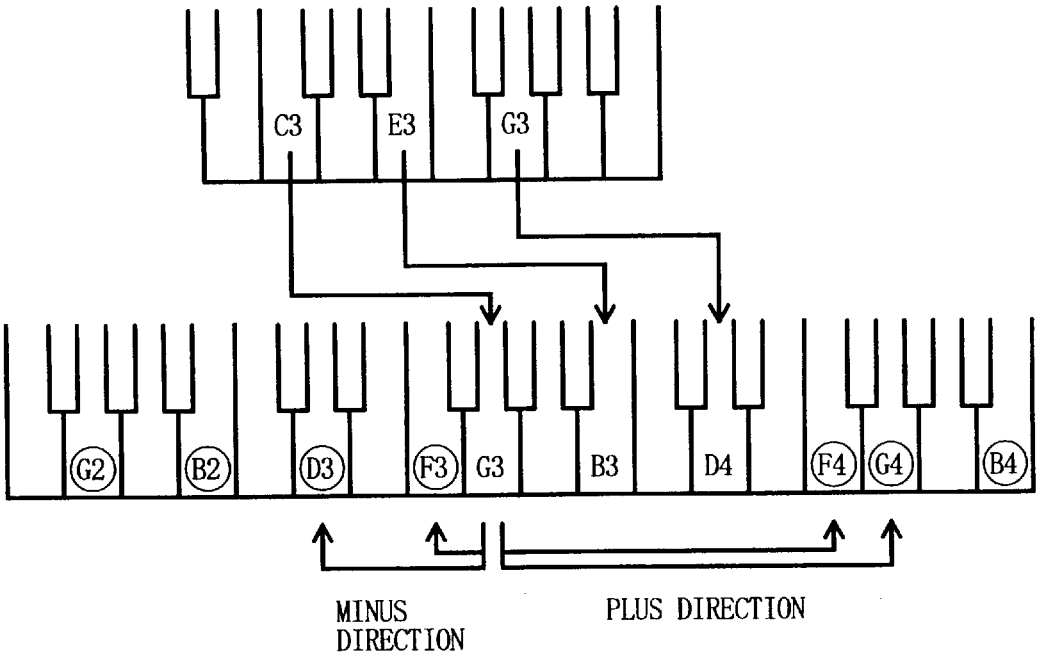
FIG. 31 is a diagram explanatory of a manner in which note numbers are tabled in the modification.

In the case of FIGS. 26A to 26C, notes numbers tabled through the key event processing will be as follows:

Here, the chord designated by the chord root and chord type data in registers ROOT and TYPE consists of notes of four different note names. When the note numbers representing tone pitches "C3", "E3" and "G3" in the note order table of FIGS. 26B and 26C have been pitch-converted on the basis of the chord root and chord type data, only one kind of the note names of the chord is left unused within the same octave range and all the four note names in ranges higher or lower than the octave range are also left unused. For example, if the chord designated by the chord root and chord type data in registers ROOT and TYPE is a G 7th chord consisting of notes of four different note names "B", "D", "F" and "G" and when the note numbers representing pitches "C3", "E3" and "G3" in the note order table of FIGS. 26B and 26C have been pitch-converted into note numbers representing tone pitches "G3", "B3" and "D4", respectively, as shown in FIG. 31, note name "F" will be left used in all ranges and all the note names "B", "D" and "G" in ranges higher or lower than the pitches "G3", "B3" and "D4" will also be left used. In this case, the note numbers representing these unused tone pitches will be tabled.

If the chord designated by the chord root and chord type data in registers ROOT and TYPE is a chord consisting of notes of three different note names and when the note numbers representing tone pitches "C3", "E3" and "G3" in the note order table of FIGS. 26B and 26C have been pitch-converted on the basis of the chord root and chord type data, all the three different note names in ranges higher or lower than the converted tone pitches will be left used. In this case, the note numbers representing these unused tone pitches will be tabled.

As another example, only unused note numbers within one or more predetermined ranges (e.g., unused note numbers in ranges higher and lower than the pitch-converted note numbers by a predetermined number of octaves) may be tabled at step S980, instead of unused note numbers in all ranges being tabled.

Figure 30:
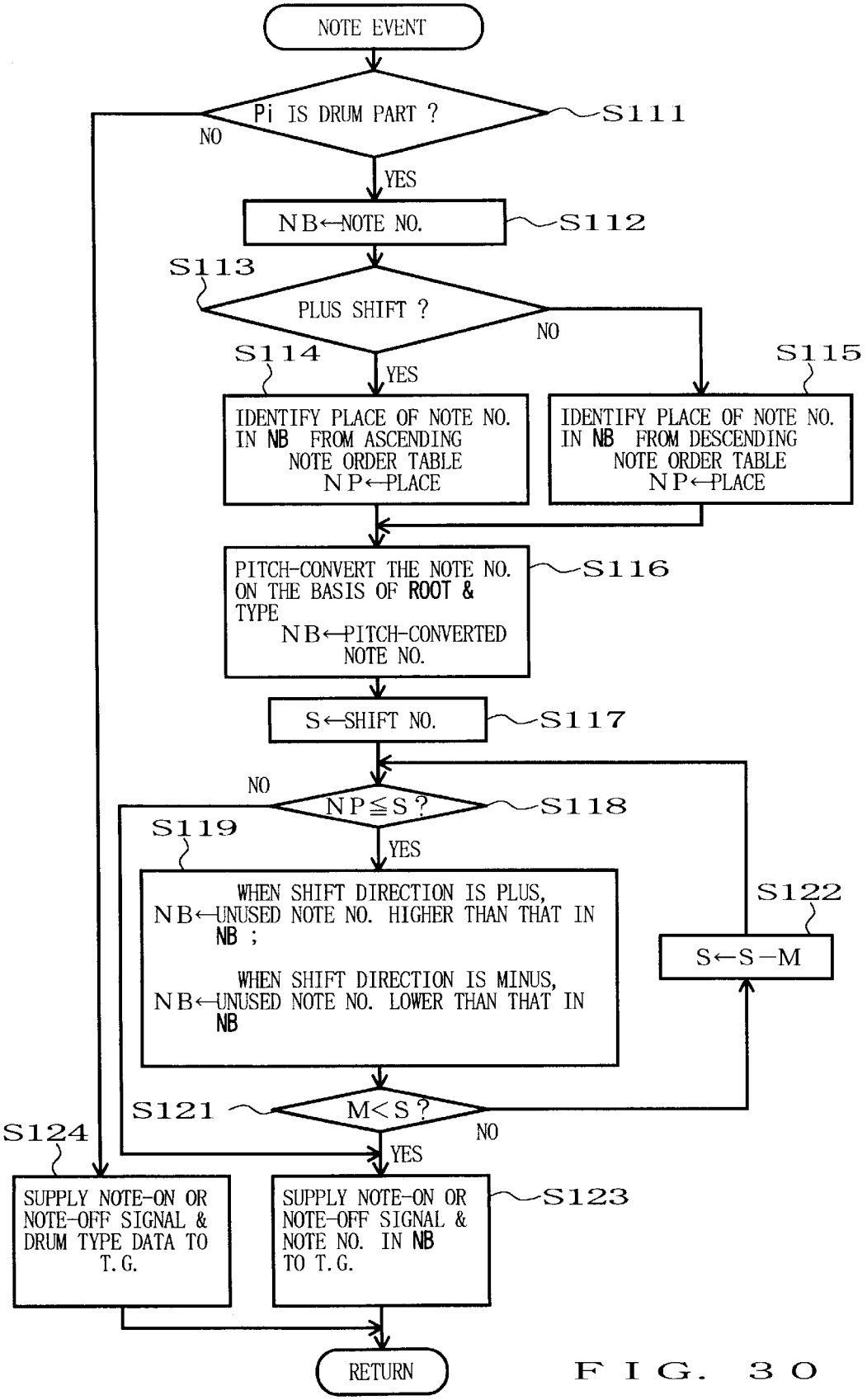
FIG. 30 is a flowchart illustrating a modification of the note event process.

FIG. 30 is a flowchart illustrating the modified note event process. In this note event process, after execution of operations of steps S111 to S118 similar to steps S710 to S780 of the note event process of FIG. 25, the following operations are executed at ste S119 using the unused note numbers tabled through the key event processing described above in relation to FIG. 29.

When the shift direction is the plus direction, any one of the unused note numbers representing a higher pitch than the note number currently written in register NB (e.g., note number representing tone pitch "F4" or "G4" where the note number in register NB represents tone pitch "G3" of FIG. 31) is written into register NB. On the other hand, when the shift direction is the minus direction, any one of the unused note numbers representing a lower tone pitch than the note number in register NB (e.g., note number representing tone pitch "F3" or "D3" where the note number in register NB represents tone pitch "G3" of FIG. 31) is written into register NB.

After step S119, the process goes to steps S121 to S123 that are similar to steps S800 to S820 of the note event process of FIG. 25 and then returns. Note that when the process again advances to step S119 by way of steps S121, S122 and S118, an even higher or lower one of the unused note numbers is selected and rewritten into register NB.

Through such a note event process, one of the component notes, corresponding to a given place in the relative pitch order, of the accompaniment pattern data for the bass and chord backing parts is shifted to one of the unused pitches. By thus shifting a tone pitch by an amount other than octave, it is possible to even further expand variations of accompaniment tones based on a same sort or group of accompaniment pattern data.

With the automatic accompaniment device arranged in the above-mentioned manner, accompaniment tones of desired range and sounding effect can be achieved with ease, even after a start of an automatic accompaniment based on selected accompaniment pattern data, by varying the shift direction and shift number via operations of the predetermined operating switches. Further, because various variations of accompaniment tones can be achieved on the basis of a same sort or group of accompaniment pattern data, the need can be eliminated for preparing many kinds of accompaniment pattern data for storage in the ROM 4 or RAM 5 so it is possible to substantially reduce the necessary time and labor for preparing the accompaniment pattern data and save storage space of the memory.

Further, in the above-described second embodiment, one of the component notes, corresponding to a given place in the relative order of tone pitch, of the accompaniment pattern data is shifted in pitch depending on the shift direction and shift number after the accompaniment pattern data read out from the ROM 4 or RAM 5 has undergone the auto. bass chord process. Conversely, the accompaniment pattern data read out from the ROM 4 or RAM 5 may be subjected to the auto. bass chord process after the component note pitch has been shifted depending on the shift direction and shift number; however, in the modifications of FIGS. 29 and 30, it is necessary to first execute the auto. bass chord process.

Furthermore, in the above-described second embodiment, the note order table preparing process prepares a pair of note order tables where note numbers are arranged in descending and ascending orders of tone pitch. However, the process may prepare a note order table in which note numbers are arranged in any other suitable order. Moreover, while the accompaniment parts in the embodiment consist of four parts: drum part; bass part; and first and second chord backing parts, they may consist of more or less than four parts. In addition, while the embodiment has been described as controlling tone pitches of component notes of accompaniment pattern data, any other tonal factor than tone pitch, such as tone volume, may be controlled depending on intended applications.

Furthermore, while the second embodiment has been described above as being applied to a keyboard-type electronic musical instrument, the present invention may also be applied to various other electronic musical instruments, such as the one of a string-instrument or percussion-instrument type, the one which carries out an automatic accompaniment on the basis of performance information supplied from a MIDI-connected external electronic musical instrument, and the one which carries out an automatic accompaniment by reproducing performance information recorded in an external storage device.

Moreover, while the second embodiment has been described above as being applied to an electronic musical instrument incorporating therein a dedicated tone generator, the present invention may also be applied to electronic musical instruments based on a so-called software tone generator (such as the one using a personal computer) as well as electronic musical instruments which cause a MIDI-connected external electronic musical instrument to carry out the tone generating process. Furthermore, it should be appreciated that the present invention is also applicable to all other sound generating devices, such as electronic game devices and karaoke devices.

Finally, the present invention arranged in the above-mentioned manner accomplishes various superior benefits as follows:

The present invention permits expanded variations of accompaniment performance based on a same sort or group of accompaniment pattern data, by controlling a tonal factor such as tone pitch or volume of accompaniment pattern data on the component-note basis. Thus, voicing as desired by the user can be readily obtained from a relatively small number of accompaniment pattern data, which eliminates the need for preparing many sorts of accompaniment pattern data for storage in memory as in the past, with the result that it is possible to substantially reduce the necessary time and labor for preparing the accompaniment pattern data and also save storage space of the memory.

The present invention achieves various variations of accompaniment tones with different ranges and sounding effects, by controlling a designated tonal factor of selected accompaniment pattern data even after a start of an automatic accompaniment based on the accompaniment pattern data. Thus, the need can be eliminated for preparing many kinds of accompaniment pattern data for storage in memory so it is possible to reduce the necessary time and labor for preparing the accompaniment pattern data and save storage space of the memory.

What is claimed is:

1. An automatic accompaniment device comprising:

a pattern data supplying section which supplies accompaniment pattern data;

an attribute determining section which determines which one of a plurality of predetermined attributes each of component notes in the accompaniment pattern data belongs to, in accordance with a relative tone pitch of the component note in the accompaniment pattern data;

a control information generating section which generates control information to control at least one tonal factor in accordance with the attribute determined by said attribute determining section for each said component note; and a control section which, with respect to each said component note having the attribute thereof determined by said attribute determining section, controls the accompaniment pattern data from said pattern data supplying section, in accordance with the control information generated by said control information generating section in correspondence with the attribute of said component note.

2. An automatic accompaniment device as claimed in claim 1 wherein said control information generating section generates control information to designate at least one of an operation for changing a tone pitch by octave and an operation for muting a generated tone.

3. An automatic accompaniment device as claimed in claim 1 wherein said attribute determining section determines an attribute of each said component note on the basis of a musical interval of said component note from a root of an accompaniment chord in the accompaniment pattern data.

4. An automatic accompaniment device as claimed in claim 1 wherein said attribute determining section includes a table where the relative tone pitch of each said component note in the accompaniment pattern data is stored in corresponding relation to one of the predetermined attributes.

5. An automatic accompaniment device as claimed in claim 1 wherein said control section includes a control manner table where a manner of controlling a tonal factor is stored for each of the predetermined attributes, said control section controlling the tonal factor of each said component note in the accompaniment pattern data on the basis of the control manner table.

6. An automatic accompaniment device as claimed in claim 5 wherein a plurality of the control manner tables are provided so that one particular manner of controlling the tonal factor is determined by selecting one of the control manner tables.

7. An automatic accompaniment device as claimed in claim 6 wherein the accompaniment pattern data contains selection information to select one of the control manner tables so that a particular manner of controlling the tonal factor is determined on the basis of the selection information.

8. An automatic accompaniment device comprising:

a storage section which stores therein accompaniment pattern data prepared on the basis of a predetermined accompaniment chord;

a chord designating section which designates a root and type of a desired accompaniment chord;

a pitch converting section which pitch-converts the accompaniment pattern data, read out from said storage section, in correspondence with the root and type designated by said chord designating section;

an attribute determining section which determines which one of a plurality of predetermined attributes each of component notes in the accompaniment pattern data belongs to, in accordance with a relative tone pitch of the component note in the accompaniment pattern data;

a control information generating section which generates control information to control at least one tonal factor in accordance with the attribute determined by said attribute determining section for each said component note; and a control section which, with respect to each said component note, controls the accompaniment pattern data in accordance with the control information generated by said control information generating section for each of the attributes.

9. An automatic accompaniment device as claimed in claim 8 wherein said control information generating section generates control information to instruct at least one of an operation for changing a tone pitch by octave and an operation for muting a generated tone.

10. An automatic accompaniment device as claimed in claim 8 wherein said attribute determining section identifies an attribute of each said component note on the basis of a musical interval of said component note from a root of an accompaniment chord in the accompaniment pattern data.

11. An automatic accompaniment device as claimed in claim 8 wherein said attribute determining section includes a table where the relative tone pitch of each said component note in the accompaniment pattern data is stored in corresponding relation to one of the predetermined attributes.

12. An automatic accompaniment device as claimed in claim 8 wherein said control section includes a control manner table where a manner of controlling the tonal factor is stored for each of the attributes, said control section controlling the tonal factor of each said component note in the accompaniment pattern data on the basis of the control manner table.

13. An automatic accompaniment device as claimed in claim 12 wherein a plurality of the control manner tables are provided so that one particular manner of controlling the tonal factor is determined by selecting one of the control manner tables.

14. An automatic accompaniment device as claimed in claim 12 wherein the accompaniment pattern data contains selection information to select one of the control manner tables so that one particular manner of controlling the tonal factor is determined on the basis of the selection information.

15. An automatic accompaniment device comprising:

a pattern data supplying section which supplies accompaniment pattern data;

a control information generating section which generates control information to control at least one tonal factor of any of component notes, of the accompaniment pattern data, corresponding to at least one given place in a relative tone pitch order; and a control section which, with respect to said component note corresponding to the given place in a relative tone pitch order, controls the accompaniment pattern data in accordance with the control information generated by said control information generating section.

16. An automatic accompaniment device comprising:

a pattern data supplying section which supplies accompaniment pattern data;

an arranging section which executes at least one of an operation for arranging component notes, of the accompaniment data supplied from said supplying section, in descending order of tone pitch and an operation for arranging the component notes in ascending order of tone pitch;

a control information generating section which generates control information to control at least one tonal factor of any of the component notes corresponding to one or more given places in one of the descending and ascending orders of tone pitch; and a control section which controls any of the component notes, of the accompaniment pattern data supplied from said supply section, corresponding to the given places for which the control information has been generated by said control information generating section, in accordance with the generated control information.

17. An automatic accompaniment device comprising:

a pattern data supplying section which supplies accompaniment pattern data;

an operator section which sets control information to control at least one tonal factor of any of component notes, of the accompaniment pattern data, corresponding to one or more given places in a relative tone pitch order; and a control section which, with respect to the component notes corresponding to the one or more given places in a relative tone pitch order, controls the accompaniment pattern data supplied from said supply section, in accordance with the control information set by said operator section.

18. An automatic accompaniment device as claimed in claim 17 wherein said operator section includes a first operator which selectively instructs that a tone pitch should be shifted in an upward or downward direction and a second operator which designates any of the component notes, of the accompaniment patten data, corresponding to one or more given places in the relative tone pitch order that are to be shifted in tone pitch, and wherein said control section controls tone pitches of the component notes designated by said second operator in such a manner that the tone pitches are shifted in the direction designated by said first operator.

19. An automatic accompaniment device comprising:

a pattern data supplying section which supplies accompaniment pattern data;

a chord designating section which designates a progression of an accompaniment chord;

a converting section which pitch-converts the accompaniment pattern data supplied from said supplying section, on the basis of an accompaniment chord designated by said chord designating section;

an identifying section which identifies any of tone pitches, of component notes of the accompaniment chord designated by said chord designating section, which is not present in the accompaniment pattern data pitch-converted by said converting section;

an operator section which designates a given place in a relative tone pitch order, of one or more component notes in the accompaniment patten data, that are to be pitch-converted; and a control section which shifts a tone pitch of the one or more component notes corresponding to the given place designated by said operator section, to any one of the tone pitches identified by said identifying section.

20. A method for controlling automatic accompaniment data comprising the steps of:

supplying accompaniment pattern data;

generating attribute information identifying which one of a plurality of predetermined attributes each of component notes in the accompaniment pattern data belongs to, in accordance with relative tone pitches of the accompaniment pattern data;

generating control information to control at least one tonal factor in accordance with the attribute information generated for each said component note; and controlling the accompaniment pattern data in accordance with the control information, whereby each tone to be generated is controlled in accordance with a particular attribute of the tone.

21. A method for controlling automatic accompaniment data comprising the steps of:

supplying accompaniment pattern data expressed with notes based on a predetermined accompaniment chord;

designating a root and type of a desired accompaniment chord;

converting tone pitches of the supplied accompaniment pattern data in correspondence with the root and type designated by said step of designating;

on the basis of a relative tone pitch of each component note in the accompaniment pattern data pitch-converted by said step of converting, determining which one of a plurality of predetermined attributes each said component note belongs to;

generating control information to control at least one tonal factor in accordance with the attribute determined for each said component note; and controlling the pitch-converted accompaniment pattern data in accordance with the control information corresponding to the attribute of each said component note.

22. A method for controlling automatic accompaniment data comprising the steps of:

supplying accompaniment pattern data;

generating control information to control at least one tonal factor of any of component notes, of the accompaniment pattern data, corresponding to at least one given place in a relative tone pitch order; and controlling the accompaniment pattern data in accordance with the control information, with respect to the component note corresponding to the given place in a relative tone pitch order.

23. A method for controlling automatic accompaniment data comprising the steps of:

supplying accompaniment pattern data;

executing at least one of an operation for arranging component notes, in the supplied accompaniment data, in descending order of tone pitch and an operation for arranging the component notes in ascending order of tone pitch;

generating control information to control at least one tonal factor of any of the component notes corresponding to one or more given places in one of the descending and ascending orders of tone pitch; and controlling the component notes, in the supplied accompaniment pattern data, corresponding to the given places for which the control information has been generated, in accordance with the generated control information.

24. A method for controlling automatic accompaniment data comprising the steps of:

supplying accompaniment pattern data;

setting control information to control at least one tonal factor of any of component notes, of the accompaniment pattern data, corresponding to one or more given places in a relative tone pitch order; and controlling the component notes, in the supplied accompaniment pattern data, corresponding to the given places for which the control information has been set, in accordance with the generated control information.

25. A method for controlling automatic accompaniment data comprising the steps of:

supplying accompaniment pattern data;

designating a desired accompaniment chord;

covering tone pitches of component notes in the supplied accompaniment pattern data, in accordance with the accompaniment chord designated by said step of designating;

identifying any of tone pitches, of component notes of the accompaniment chord designated by said chord designating section, which is not present in the accompaniment pattern data converted by said step of converting, as an unused tone pitch;

with respect to any of the component notes, of the accompaniment pattern data, corresponding to one or more given places in a relative tone pitch order, instructing that a tone pitch of the component note should be shifted; and shifting the tone pitch of the component note corresponding to the one or more given places in a relative tone pitch order, to the unused tone pitch identified by said step of identifying.

26. A machine-readable recording medium containing a group of instructions to cause said machine to implement a method for controlling automatic accompaniment data comprising the steps of:

supplying accompaniment pattern data;

generating attribute information identifying which one of a plurality of predetermined attributes each of component notes in the accompaniment pattern data belongs to, in accordance with relative tone pitches of the accompaniment pattern data;

generating control information to control at least one tonal factor in accordance with the attribute information generated for each said component note; and controlling the accompaniment pattern data in accordance with the control information, whereby each tone to be generated is controlled in accordance with a particular attribute of the tone.

27. A machine-readable recording medium containing a group of instructions to cause said machine to implement a method for controlling automatic accompaniment data comprising the steps of:

supplying accompaniment pattern data expressed with notes based on a predetermined accompaniment chord;

designating a root and type of a desired accompaniment chord;

converting tone pitches of the supplied accompaniment pattern data in correspondence with the root and type designated by said step of designating;

on the basis of a relative tone pitch of each component note in the accompaniment pattern data pitch-converted by said step of converting, determining which one of a plurality of predetermined attributes each said component note belongs to;

generating control information to control at least one tonal factor in accordance with the attribute determined for each said component note; and controlling the pitch-converted accompaniment pattern data in accordance with the control information corresponding to the attribute of each said component note.

28. A machine-readable recording medium containing a group of instructions to cause said machine to implement a method for controlling automatic accompaniment data comprising the steps of:

supplying accompaniment pattern data;

generating control information to control at least one tonal factor of any of component notes, of the accompaniment pattern data, corresponding to at least one given place in a relative tone pitch order; and controlling the accompaniment pattern data in accordance with the control information, with respect to the component note corresponding to the given place in a relative tone pitch order.

29. A machine-readable recording medium containing a group of instructions to cause said machine to implement a method for controlling automatic accompaniment data comprising the steps of:

supplying accompaniment pattern data;

executing at least one of an operation for arranging component notes, in the supplied accompaniment data, in descending order of tone pitch and an operation for arranging the component notes in ascending order of tone pitch;

generating control information to control at least one tonal factor of any of the component notes corresponding to one or more given places in one of the descending and ascending orders of tone pitch; and controlling the component notes, in the supplied accompaniment pattern data, corresponding to the given places for which the control information has been generated, in accordance with the generated control information.

30. A machine-readable recording medium containing a group of instructions to cause said machine to implement a method for controlling automatic accompaniment data comprising the steps of: supplying accompaniment pattern data;

setting control information to control at least one tonal factor of any of component notes, of the accompaniment pattern data, corresponding to one or more given places in a relative tone pitch order; and controlling the component notes, in the supplied accompaniment pattern data, corresponding to the given places for which the control information has been set, in accordance with the generated control information.

31. A machine-readable recording medium containing a group of instructions to cause said machine to implement a method for controlling automatic accompaniment data comprising the steps of:

supplying accompaniment pattern data;

designating a desired accompaniment chord;

covering tone pitches of component notes in the supplied accompaniment pattern data, in accordance with the accompaniment chord designated by said step of designating;

identifying any of tone pitches, of component notes of the accompaniment chord designated by said chord designating section, which is not present in the accompaniment pattern data converted by said step of converting, as an unused tone pitch;

with respect to any of the component notes, of the accompaniment pattern data, corresponding to one or more given places in a relative tone pitch order, instructing that a tone pitch of the component note should be shifted; and shifting the tone pitch of the component note corresponding to the one or more given places in a relative tone pitch order, to the unused tone pitch identified by said step of identifying.

* * * * *